US011529543B2

(12) United States Patent
Miller et al.

(10) Patent No.: US 11,529,543 B2
(45) Date of Patent: Dec. 20, 2022

(54) EXERCISE DEVICE HAVING A LINEAR ARM PORTION

(71) Applicant: Proteus Motion Inc., Brooklyn, NY (US)

(72) Inventors: Samuel Adam Miller, Brooklyn, NY (US); Michael Anthony Charpin, Brooklyn, NY (US); Michael Tinker, Brooklyn, NY (US); Paul Joseph Vizzio, Brooklyn, NY (US)

(73) Assignee: Proteus Motion Inc., Brooklyn, NY (US)

( * ) Notice: Subject to any disclaimer, the term of this patent is extended or adjusted under 35 U.S.C. 154(b) by 0 days.

(21) Appl. No.: 17/205,183

(22) Filed: Mar. 18, 2021

(65) Prior Publication Data

US 2021/0291010 A1 Sep. 23, 2021

Related U.S. Application Data

(60) Provisional application No. 62/991,875, filed on Mar. 19, 2020, provisional application No. 63/122,057, filed on Dec. 7, 2020.

(51) Int. Cl.
*A63B 21/00* (2006.01)

(52) U.S. Cl.
CPC ..... *A63B 21/4047* (2015.10); *A63B 21/4011* (2015.10); *A63B 21/4017* (2015.10); *A63B 21/4045* (2015.10)

(58) Field of Classification Search
CPC ..... A63B 21/00058; A63B 21/00069; A63B 21/00072; A63B 21/00076;
(Continued)

(56) References Cited

U.S. PATENT DOCUMENTS 4,221,516 A * 9/1980 Haaker ..... B25J 3/00 414/6
4,773,398 A 9/1988 Tatom
(Continued)

FOREIGN PATENT DOCUMENTS

EP 3 471 843 A1 4/2019

OTHER PUBLICATIONS

PCT International Search Report and Written Opinion for International Application No. PCT/US2021/022937, entitled "Excercise Device," dated Jul. 22, 2021.

*Primary Examiner* — Nyca T Nguyen
*Assistant Examiner* — Zachary T Moore
(74) *Attorney, Agent, or Firm* — Hamilton, Brook, Smith & Reynolds, P.C.

(57) ABSTRACT

An exercise apparatus includes a linear arm portion having an elongate arm member with proximal and distal ends and an elongate support member having proximal and distal ends. The arm member can be slidably mounted to the support member by a sliding joint. A linear arm brake assembly can be coupled to the arm member for resisting linear motion of the arm member. A torso portion can be included to which the linear arm portion is rotatably mounted about a second axis by rotary shoulder joint. The linear arm portion can be configured, and the rotary shoulder joint can be positioned along the length of the support member at a location that substantially balances the linear arm portion about the rotary shoulder joint at least when the arm member is in the retracted position.

28 Claims, 29 Drawing Sheets

(58) Field of Classification Search
CPC ..... A63B 21/00178; A63B 21/00181; A63B 21/00192; A63B 21/005; A63B 21/0051; A63B 21/0056; A63B 21/0057; A63B 21/0058; A63B 21/0059; A63B 21/0083; A63B 21/0085; A63B 21/0087; A63B 21/15; A63B 21/158; A63B 21/159; A63B 21/06; A63B 21/0615; A63B 21/0616; A63B 21/0617; A63B 21/4041; A63B 21/4045; A63B 21/4047; A63B 21/4049
See application file for complete search history.

(56) References Cited

U.S. PATENT DOCUMENTS 5,163,451 A 11/1992 Grellas
5,179,939 A 1/1993 Donovan et al.
5,417,643 A * 5/1995 Taylor ..... A61H 1/0274 601/24
5,755,645 A * 5/1998 Miller ..... A63B 21/153 482/903
5,830,160 A * 11/1998 Reinkensmeyer ..... A61B 5/224 600/595
7,837,599 B2 * 11/2010 Kowalczewski ..... A63B 23/12 482/904
8,177,732 B2 5/2012 Einav et al.
8,950,286 B2 * 2/2015 Gosselin ..... B25J 3/04 74/490.06
9,764,191 B2 9/2017 Oshima et al.
10,039,682 B2 8/2018 Einav et al.
10,888,732 B2 1/2021 Miller et al.
2016/0107021 A1 * 4/2016 Bakrac ..... A63B 21/1609 482/139
2017/0361165 A1 * 12/2017 Miller ..... A63B 21/00178
2017/0361166 A1 * 12/2017 Hong ..... A63B 24/0062

* cited by examiner

FIG. 9
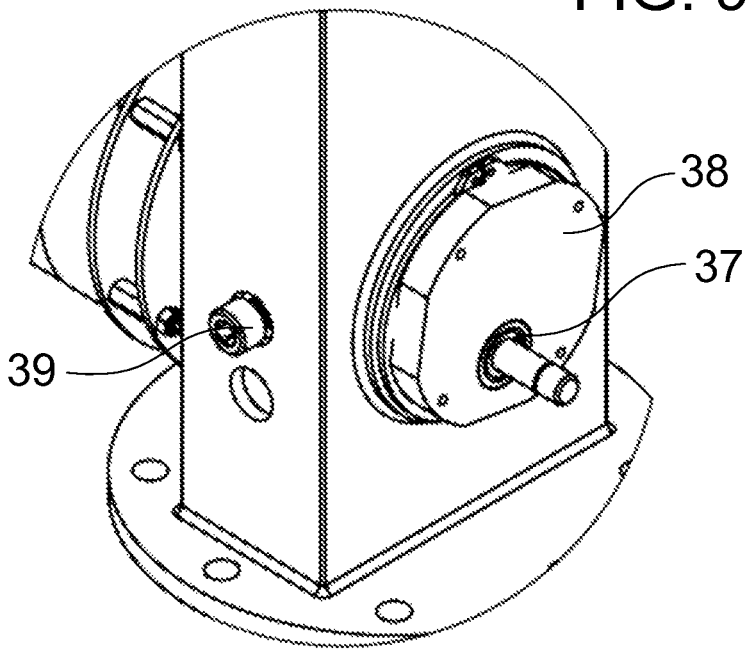
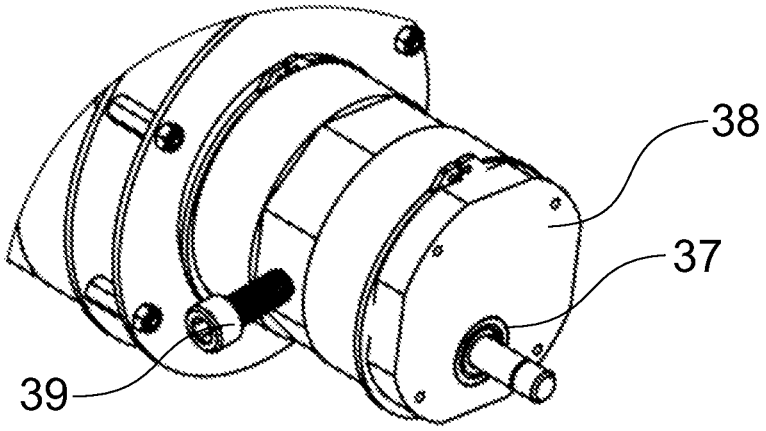
FIG. 10

FIG. 24
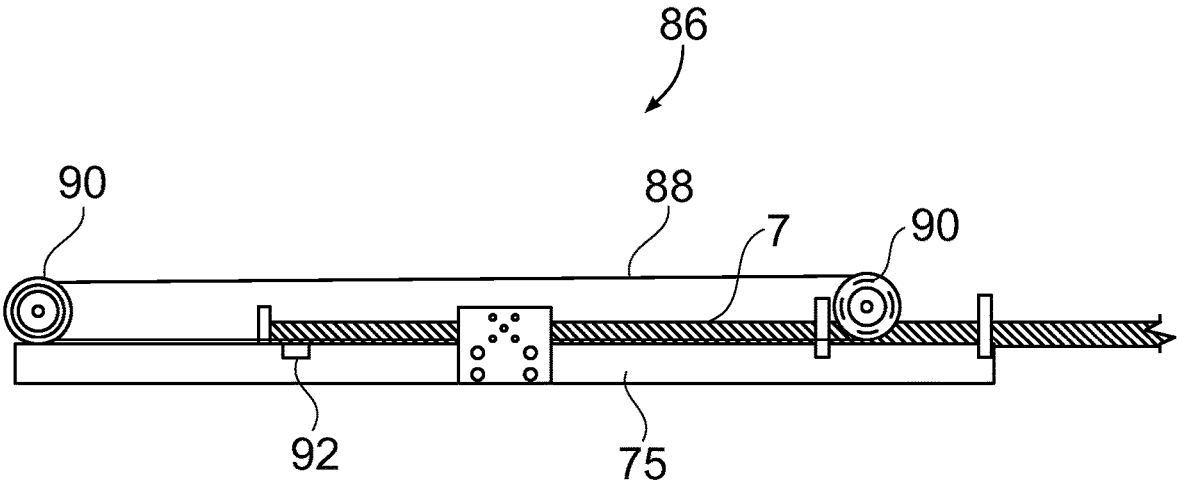
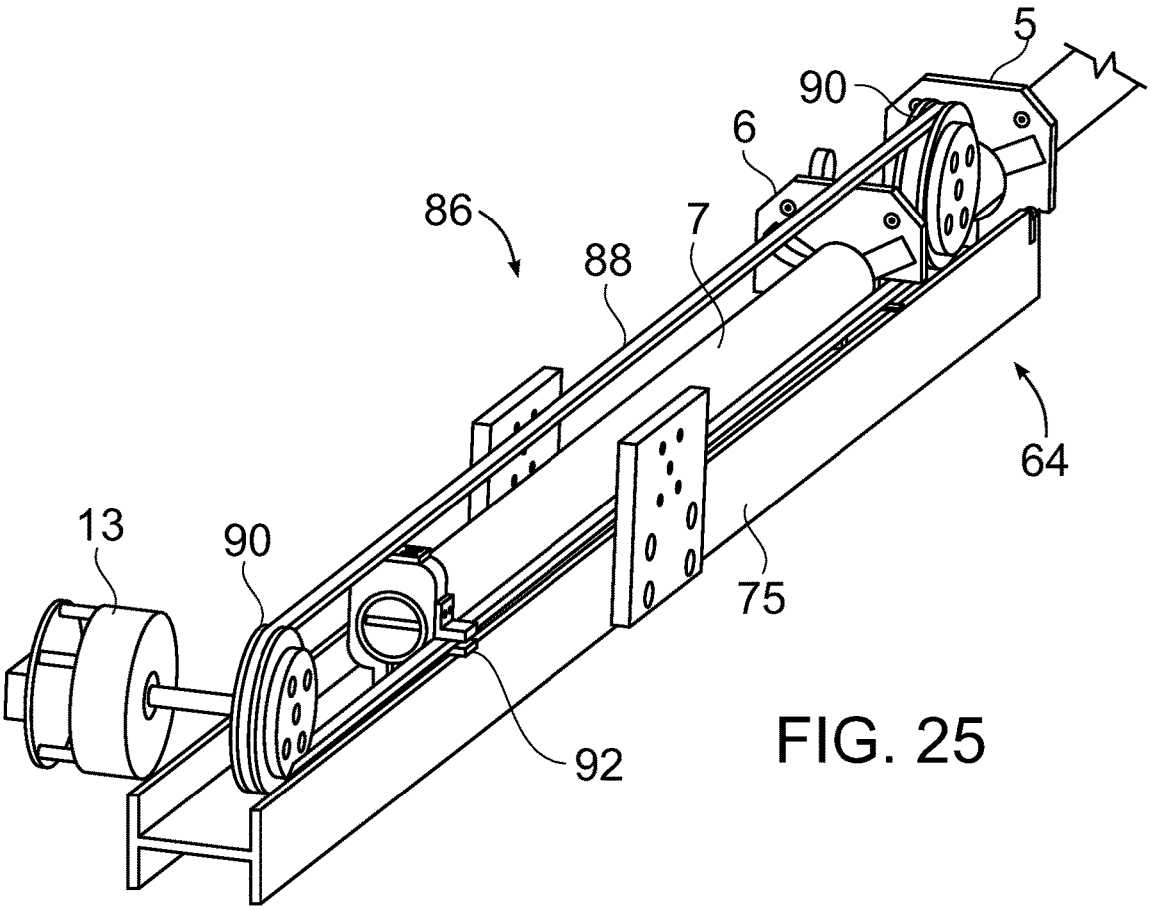
FIG. 25

EXERCISE DEVICE HAVING A LINEAR ARM PORTION

RELATED APPLICATIONS

This application claims the benefit of U.S. Provisional Application No. 62/991,875, filed on Mar. 19, 2020 and U.S. Provisional Application No. 63/122,057, filed on Dec. 7, 2020. The entire teachings of the above applications are incorporated herein by reference.

BACKGROUND

Six degree of freedom exercise devices in the prior art can have issues related to friction and/or inertia of moving parts, as well as high cost, excessive assembly time, reliability, strength, and limited functionality.

SUMMARY

The present invention can provide an exercise apparatus that can exercise complex motions with six degrees of freedom, having minimized size, friction and inertia, allowing for an improved exercise experience, increased reliability, more linear force response, and increased precision of resistance output was well as measurement over that in the prior art.

The exercise apparatus can include a linear arm portion having an elongate arm member with proximal and distal ends and an elongate support member having proximal and distal ends. The arm member can be slidably mounted to the support member by a sliding joint positioned at the distal end of the support member. The arm member can be movable along a first axis between retracted and extended positions relative to the support member. The sliding joint can include first and second bearing assemblies which are spaced apart a sufficient distance from each other for constraining portions of the arm member within the sliding joint along the first axis at the distal end of the support member. The proximal end of the arm member that overlaps with the support member outside of the sliding joint when in retracted positions is unconstrained relative to the first axis. A linear arm brake assembly can be coupled to the arm member for resisting linear motion of the arm member. A torso portion can be included to which the linear arm portion is rotatably mounted about a second axis by a rotary shoulder joint located at about half way or midway along the length of the support member of the linear arm portion.

In particular embodiments, the torso portion can include a central support member extending along a third axis. The torso portion can be rotatable about the third axis by a rotary waist joint. Some embodiments may enable rotation over 360 degrees. A shoulder brake assembly can be mounted to the central support member for resisting movement of the rotary shoulder joint. The shoulder brake assembly can include a shoulder brake transmission having components positioned on opposite sides of the central support member and the third axis for minimizing rotational size and rotational inertia of the torso portion. The torso portion can be rotatably mounted about the third axis to a base by the waist joint. The base can include a base support member. A waist brake assembly can be mounted to the base support member for resisting movement of the rotary waist joint. The waist brake assembly can include a waist brake transmission. Transmission components can be positioned on opposite sides of the base support member for minimizing size of the base. The linear arm brake assembly can include a cable or belt secured to the arm member. An arm brake pulley that is engaged by the cable or belt can be rotatably coupled to an arm brake. The shoulder brake assembly can include at least one timing belt transmission stage rotatably coupled to a shoulder brake. The waist brake assembly can include at least one timing belt transmission stage rotatably coupled to a waist brake. The cable or belt of the arm brake assembly can engage a first support member pulley at the proximal end of the support member and a second support member pulley located at the sliding joint inward from the distal end of the support member. The sliding joint can extend from the distal end of the support member overlapping the support member about ⅓ or less of the length of the support member.

The present invention can also provide an exercise apparatus including a linear arm portion having an elongate arm member with proximal and distal ends and an elongate support member having proximal and distal ends. The arm member can be slidably mounted to the support member by a sliding joint positioned at the distal end of the support member. The arm member can be movable along a first axis between retracted and extended positions relative to the support member. The sliding joint can include first and second bearing assemblies which are spaced apart a sufficient distance from each other for constraining portions of the arm member within the sliding joint along the first axis at the distal end of the support member. The proximal end of the arm member that overlaps with the support member outside of the sliding joint when in retracted positions can be capable of some unconstrained lateral movement relative to the first axis. A linear arm brake assembly can be coupled to the arm member for resisting linear motion of the arm member. A torso portion can be included to which the linear arm portion is rotatably mounted about a second axis by rotary shoulder joint. The linear arm portion can be configured, and the rotary shoulder joint can be positioned along the length of the support member at a location that substantially balances the linear arm portion about the rotary shoulder joint at least when the arm member is in the retracted position.

In particular embodiments, the torso portion can include a central support member extending along a third axis. The torso portion can be rotatable about the third axis by a rotary waist joint. A shoulder brake assembly can be mounted to the central support member for resisting movement of the rotary shoulder joint. The shoulder brake assembly can include a shoulder brake transmission having components positioned on opposite sides of the central support member and the third axis for minimizing rotational size and rotational inertia of the torso portion. The torso portion can be rotatably mounted about the third axis to a base by the waist joint. The base can include a base support member. A waist brake assembly can be mounted to the base support member for resisting movement of the waist joint. The waist brake assembly can include a waist brake transmission. The linear arm brake assembly can include a timing belt transmission secured to the arm member. An arm brake can be rotatably coupled to the timing belt transmission. The shoulder brake assembly can include at least one timing belt transmission stage rotatably coupled to a shoulder brake, and the waist brake assembly can include at least one timing belt transmission stage rotatably coupled to a waist brake. The belt of the arm brake assembly can engage a first support member pulley at the proximal end of the support member and a second support member pulley located at the sliding joint inward from the distal end of the support member. A counterweight can be secured to the belt near the second support member pulley when the arm member is in the retracted position. The rotary shoulder joint can be positioned inward about ¼ to ⅓ of a length of the support member from the distal end. The counterweight and the arm brake can be positioned on a side of the rotary shoulder joint that is opposite to the proximal end of the support member to substantially balance the linear arm portion about the rotary shoulder joint when the arm member is in the retracted position. The base can include a pair or two legs extending from the base support member on opposite sides of the torso portion. A third or single leg can extend from the base support member spaced apart from and extending between the pair of legs. The legs can include at least one of retractable rollers for moving the apparatus, leveling mechanisms for leveling the apparatus, and mounting holes. The rotary shoulder joint can include a linear arm mounting bracket rotatably mounted to the shoulder brake transmission. The linear arm portion can be removably securable to the linear arm mounting bracket. The sliding joint can extend from the distal end of the support member overlapping the support member about ⅓ or less of the length of the support member.

The present invention can also provide an exercise apparatus including a linear arm portion having an elongate arm member with proximal and distal ends and an elongate support member having proximal and distal ends. The arm member can be slidably mounted to the support member by a sliding joint positioned at the distal end of the support member. The arm member can be movable along a first axis between retracted and extended positions relative to the support member. The sliding joint can include first and second bearing assemblies which are spaced apart a sufficient distance from each other for constraining portions of the arm member within the sliding joint along the first axis at the distal end of the support member. The proximal end of the arm member that overlaps with the support member outside of the sliding joint when in retracted positions can be capable of some unconstrained lateral movement relative to the first axis. A linear arm brake assembly can be coupled to the arm member for resisting linear motion of the arm member. The linear arm brake assembly can include a timing belt transmission secured to the arm member. An arm brake can be rotatably coupled to the timing belt transmission. The belt of the arm brake assembly can engage a first support member pulley at the proximal end of the support member and a second support member pulley located at the sliding joint inward from the distal end of the support member. A counterweight can be secured to the belt near the second support member pulley when the arm member is in the retracted position. A torso portion can be included to which the linear arm portion is rotatably mounted about a second axis by rotary shoulder joint. The rotary shoulder joint can be positioned inward about ¼ to ⅓ of a length of the support member from the distal end. The counterweight and the arm brake can be positioned on a side of the rotary shoulder joint that is opposite to the proximal end of the support member to substantially balance the linear arm portion about the rotary shoulder joint when the arm member is in the retracted position.

The present invention can also provide a method of exercising with an exercise apparatus including engaging a linear arm portion having an elongate arm member with proximal and distal ends and an elongate support member having proximal and distal ends. The distal end of the arm member can have an interface device or handle for engagement by a user. The arm member can be slidably mounted to the support member by a sliding joint positioned at the distal end of the support member. The arm member can be movable along a first axis between retracted and extended positions relative to the support member. The sliding joint can include first and second bearing assemblies which are spaced apart a sufficient distance from each other for constraining portions of the arm member within the sliding joint along the first axis at the distal end of the support member. The proximal end of the arm member that overlaps with the support member outside of the sliding joint when in retracted positions can be capable of some unconstrained lateral movement relative to the first axis. Linear motion of the arm member can be resisted with a linear arm brake assembly coupled to the arm member. Rotary motion of the linear arm portion can be allowed relative to a torso portion to which the linear arm portion is rotatably mounted about a second axis by a rotary shoulder joint. The linear arm portion can be configured, and the rotary shoulder joint can be positioned along the length of the support member at a location that substantially balances the linear arm portion about the rotary shoulder joint at least when the arm member is in the retracted position.

In particular embodiments, the torso portion can include a central support member extending along a third axis. The torso portion can be rotatable about the third axis by a rotary waist joint allowing rotary motion of the torso portion. A shoulder brake assembly can be mounted to the central support member for resisting movement of the rotary shoulder joint. The shoulder brake assembly can include a shoulder brake transmission having components positioned on opposite sides of the central support member and the third axis for minimizing rotational size and rotational inertia of the torso portion. The torso portion can be rotatably mounted about the third axis to a base by the waist joint. The base can include a base support member. A waist brake assembly can be mounted to the base support member for resisting movement of the waist joint. The waist brake assembly can include a waist brake transmission. The linear arm brake assembly can include a timing belt transmission secured to the arm member. An arm brake can be rotatably coupled to the timing belt transmission. The shoulder brake assembly can include at least one timing belt transmission stage rotatably coupled to a shoulder brake. The waist brake assembly can include at least one timing belt transmission stage rotatably coupled to a waist brake. The belt of the arm brake assembly can engage a first support member pulley at the proximal end of the support member and a second support member pulley located at the sliding joint inward from the distal end of the support member. A counterweight can be secured to the belt near the second support member pulley when the arm member is in the retracted position. The rotary shoulder joint can be positioned inward about ¼ to ⅓ of a length of the support member from the distal end. The counterweight and the arm brake can be positioned on a side of the rotary shoulder joint that is opposite to the proximal end of the support member to substantially balance the linear arm portion about the rotary shoulder joint when the arm member is in the retracted position. The base can support the exercise device with a pair or two legs extending from the base support member on opposite sides of the torso portion. A third or single leg can extend from the base support member spaced apart from and extending between the pair of legs. The legs can include at least one of retractable rollers for moving the apparatus, leveling mechanisms for leveling the apparatus, and mounting holes. The rotary shoulder joint can include a linear arm mounting bracket rotatably mounted to the shoulder brake transmission. The linear arm portion can be removably securable to the linear arm mounting bracket. The sliding joint can extend from the distal end of the support member overlapping the support member about ⅓ or less of the length of the support member.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIGS. 8-10 are enlarged details of bearing assemblies.

FIGS. 24-27 are side, perspective and enlarged views of the linear arm portion of the embodiment of FIGS. 23A-23C.

DETAILED DESCRIPTION

Figure 1:
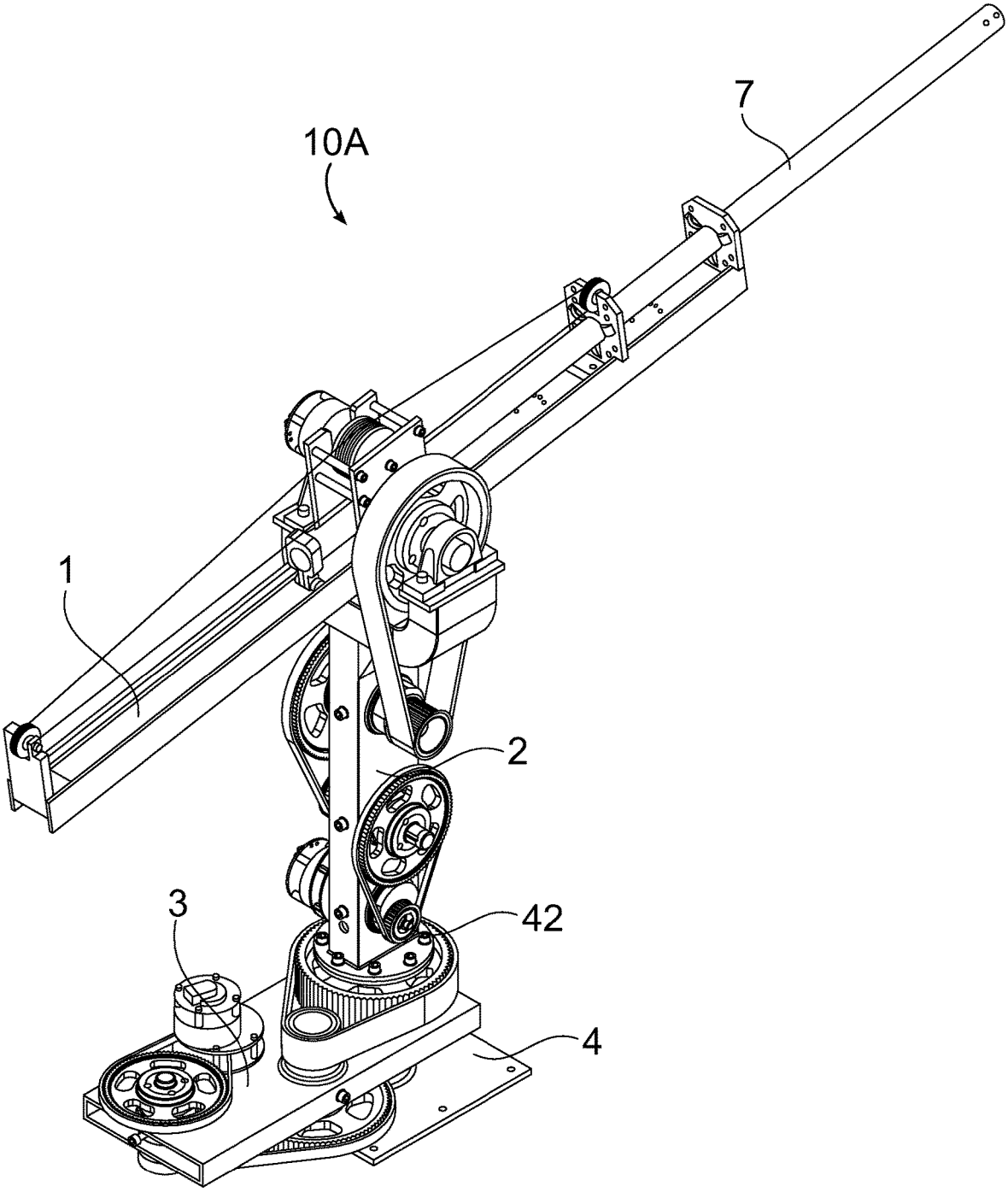
FIG. 1 is a perspective view of an embodiment of an exercise apparatus in the present invention.

Details of some embodiments of the exercise apparatus in the present invention are described below. Referring to FIGS. 1-22, in some embodiments, the arm member of exercise apparatus or device 10A can be a tube 7 (FIGS. 2 and 22) that linearly moves along axis $A_1$ over the support member 75, which can be a rail or I-beam shaped. A limb interface device or handle 70 with multiple degrees of freedom can be secured to the distal end of the arm member 7 for gripping by the user for exercising. The sliding joint 64 can be formed of roller assemblies 5 and 6 (FIGS. 2 and 3), with roller assembly 5 positioned at the distal end of the support member 75, and roller assembly 6 positioned about ⅙ the length of the support member 75 away. By positioning the sliding joint at the distal end of the support member 75 while extending such a length inward from the distal end of the support member 75, and having the proximal end of the arm member 7 laterally or orthogonally unconstrained relative to axis $A_1$ the arm member 7 can bend or flex orthogonally during heavy exercise but can still slide within the sliding joint 64 with a low friction. In the prior art, the proximal end of the arm member was slidably mounted to a support member that could bend under bending of the arm member, and cause increased friction. The limb interface device 70 can be secured to the arm member 7 by a quick disconnect coupler 71, which can be spring-loaded. The design of the linear arm portion can allow for easy manipulation of tension on the arm, as well as uniform friction. The wheels or rollers in the roller assemblies 5 and 6 can be equidistantly spaced, and semi-compressible and tolerant of levels of dirt or grime without increasing friction. The linear arm portion or linear motion stage 1 can be rotatably coupled to the torso portion or polar angular motion stage 2 (FIGS. 1 and 22) with the rotary shoulder joint 76, about a lateral or horizontal axis $A_2$. The torso portion 2 can be rotatably coupled to the base, waist, or azimuthal angular motion stage 3 by waist joint 78, and can be rotatable about a vertical axis $A_3$. A stand or removable base 4 can be bolted to the floor, wall or ceiling, or can be freestanding. If bolted to the floor or wall, the orientation of the components can vary accordingly. The rotary shoulder joint 76 can be positioned about halfway or midway along the length of support member 75, which can provide some static and/or dynamic balancing about axes $A_2$ and $A_3$. Brake 13 can also be at the midway position.

The transmission stages for the torso 2 and base 3 portions can include timing belts and pulleys, which decrease in width and weight for the purpose of increasing strength and decreasing costs, in addition to being on opposite sides of the respective support members. Pulleys on opposite sides of a support member can be rotatably coupled to each other or a brake by a common transmission shaft extending through the support member along respective horizontal or vertical axes. This can minimize size, and in the torso portion, can minimize the distance or rotational radius away from the axis $A_3$ that the weight of the shoulder brake assembly is located to minimize rotational inertia. Using belts for rotating the waist joint 78 can allow unrestricted rotary motion 360 degrees and beyond. The number of the transmission stages, as well as the sizing and gear ratios of the transmission stages, can vary depending upon the amount of force expected to be exerted on the exercise apparatus, as well as the desired safety factor. In some embodiments, the safety factor can be a 6× safety factor, and in other embodiments, it can be less. Alternatively, other transmissions can be used such as V-belt, chain or gear transmissions, including planetary/epicyclic and cycloid configurations. The cable transmission for the arm member can also be replaced with any of these transmissions, while maintaining backlash requirements. A bushing system can provide for variable tensioning which further can allow for adjustable or variable backlash and friction trade-offs for maximum customization. The magnetic particle brakes 13, 31 and 58 can be connected to a controller 74, for example by a line 72 or wirelessly, for controlling the exercise machine as well as generating and storing data.

In some embodiments, shoulder and/or waist transmissions having three transmission stages can be sized to provide an overall ratio of about 32:1, where three stages each having about 3.2:1 ratios can be rotatably connected together in series. The particle brake can have about 10 ft-lbs max torque, and about 1800 RPM max. The handle 70 of the exercise apparatus can be moved during exercise with a max speed of about 10 m/sec and with about 35 lbs max force.

In other embodiments of the present invention, refer to FIGS. 23A-23C, and 24-27 an exercise apparatus 80 can have a shoulder brake transmission 82 with two transmission stages, with each stage 82*a* and 82*b* positioned on opposite sides of the central support member. The waist brake transmission 84 can also have two transmission stages, with each stage 84*a* and 84*b* positioned on opposite sides of the base support member. The two stage transmission is simpler, smaller, less expensive, easier to assemble and maintain, and has less backlash than the three stage transmission. In some embodiments, shoulder and/or waist transmissions having two transmission stages can be sized to provide an overall ratio of about 16:1, and can have one stage with about a 5.3:1 ratio and the other stage with about a 3:1 ratio rotatably connected together in series. The particle brake can have about 18 ft-lbs max torque, and about 1000 RPM max. With such transmissions, the handle 70 of the exercise apparatus 80 can be moved during exercise with a max speed of about 10 m/sec and with about 35 lbs max force. In other embodiments, two 4:1 ratio stages can be connected together.

The linear arm brake assembly 86 can have a timing belt 88 positioned over two timing belt pulleys 90 that are rotatably mounted to the arm support member 75 as shown. Brake 13 can be coupled to the pulley 90 positioned at the proximal end of the arm support member 75. The timing belt 88 can be connected to or attached to or near the proximal end of the arm member 7 with a connecting member 92 such as a clamp, thereby providing linear motion resistance to the arm member 7.

In other embodiments, exercise apparatus 80 can include shoulder and/or waist transmissions having a single transmission stage that can be sized to provide a ratio of about 6.3:1. The particle brake can have about 18 ft-lbs max torque, and about 1000 RPM max. With a slight change in the length of the linear arm portion and/or arm member 7, the handle 70 of the exercise apparatus can be moved during exercise with a max speed of about 20 m/sec and with about 15 lbs max force. The lower rating can allow smaller shafts, pulleys, gears, etc. to be used.

Additional details of embodiments of the exercise apparatus now follows.

Solutions provided.

OTS belt/pulley system:

Reduced cost.

Reduced physical size and weight.

Reduced assembly time.

Increased precision of measurements and resistance.

Improved durability and resistance to wear in the field.

Ease of serviceability—belts can be retensioned and replaced without disassembling the entire system stage. Can be performed by non-expert technician or client/owner of system.

Meets ASTM safety guidelines (6× on structural parts, 4× on all other mechanical parts).

Linear stage: reduced friction throughout by eliminating carriage/wheels and rail and adding a second front stop with rollers.

Range of motion of base stage (left/right) can be unrestricted 360 degrees with belts and pulleys.

Referring to FIG. 1 the design can consist of three stage assemblies (1-3) and a removable base (4). Of the three stages, one controls linear motion (1) and the other two control angular motion (2, 3). The selection of the motion stages can correspond to that of a spherical coordinate system where the linear motion stage controls radial distance and the two angular motion stages control polar and azimuthal angle.

Figure 2:
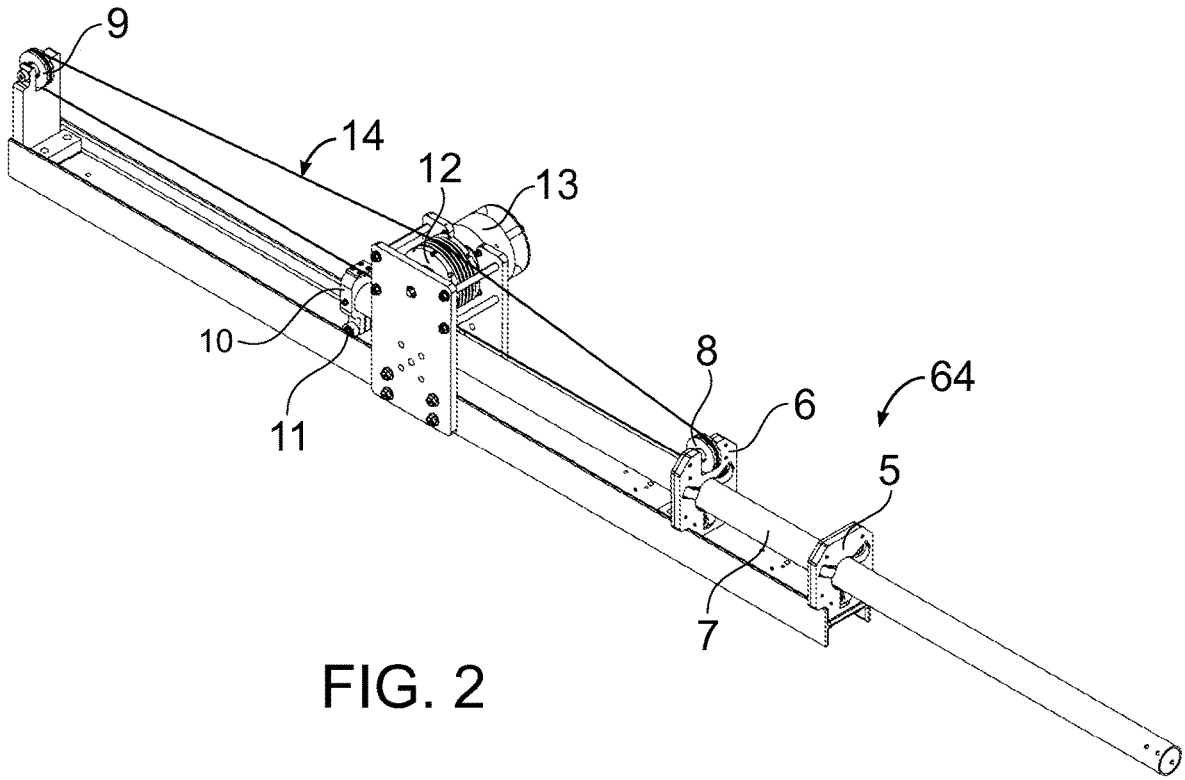
FIG. 2 is a perspective view of an embodiment of a linear arm portion.
Figure 3:
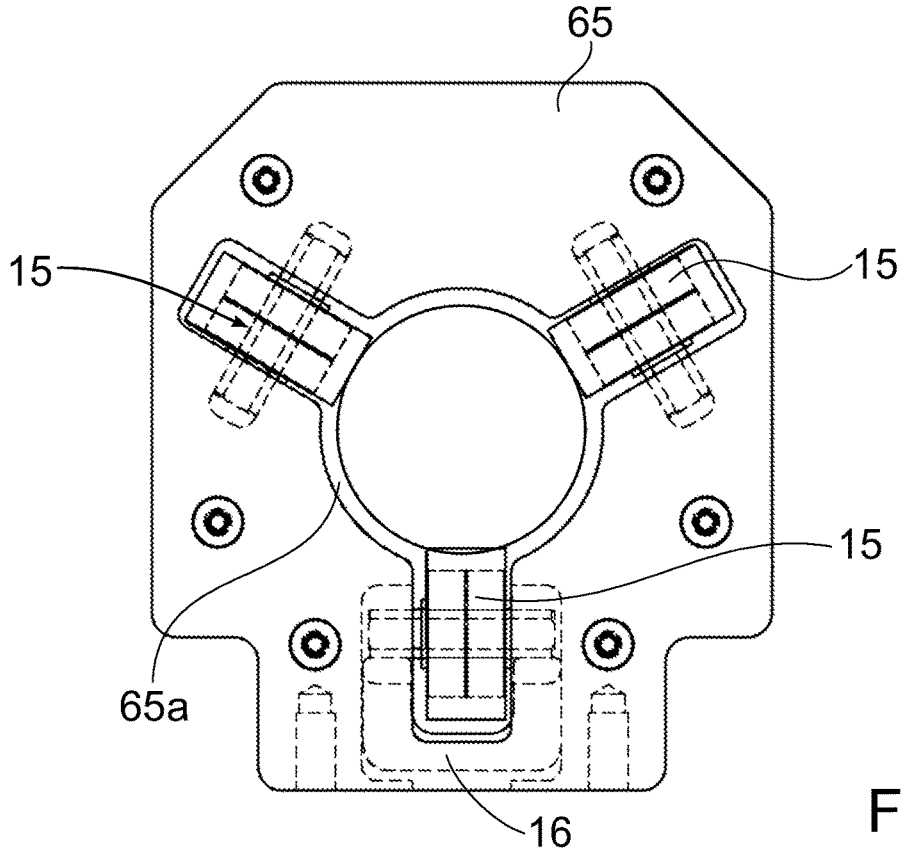
FIG. 3 is a front view of a roller assembly.

Referring to FIGS. 2 and 3, the linear motion stage can guide a tube (7) through two roller assemblies (5, 6). The roller assemblies (5, 6) can each consist of three equally spaced wheel bearing assemblies (15) with an adjustable mount (16) that is controlled by a set screw in the support of (1). The bearing assemblies are positioned such that the tube is supported evenly by each and the amount of force holding the tube in place can be adjusted for optimal usage. The tube is held within the linear motion assembly by a stopper (10) that prevents the tube from passing through (6) or exiting the rear of the assembly. The angular or rotational position of the tube can be held in place by two bearing rollers or wheels (11) at the bottom of the stopper (10). The amount of force applied to the tube is ultimately controlled by a magnetic particle brake (13) and its position is determined by a shaft mounted optical encoder. The brake (13) is connected to a shaft mounted pulley assembly (12) containing helical grooves. Attached to either end of the pulley assembly (12) is a steel cable (14) which runs through the helical grooves and then to mounted pulleys (8, 9) that line the cable up with the cable mounts on top of the tube stopper (10).

Figure 4:
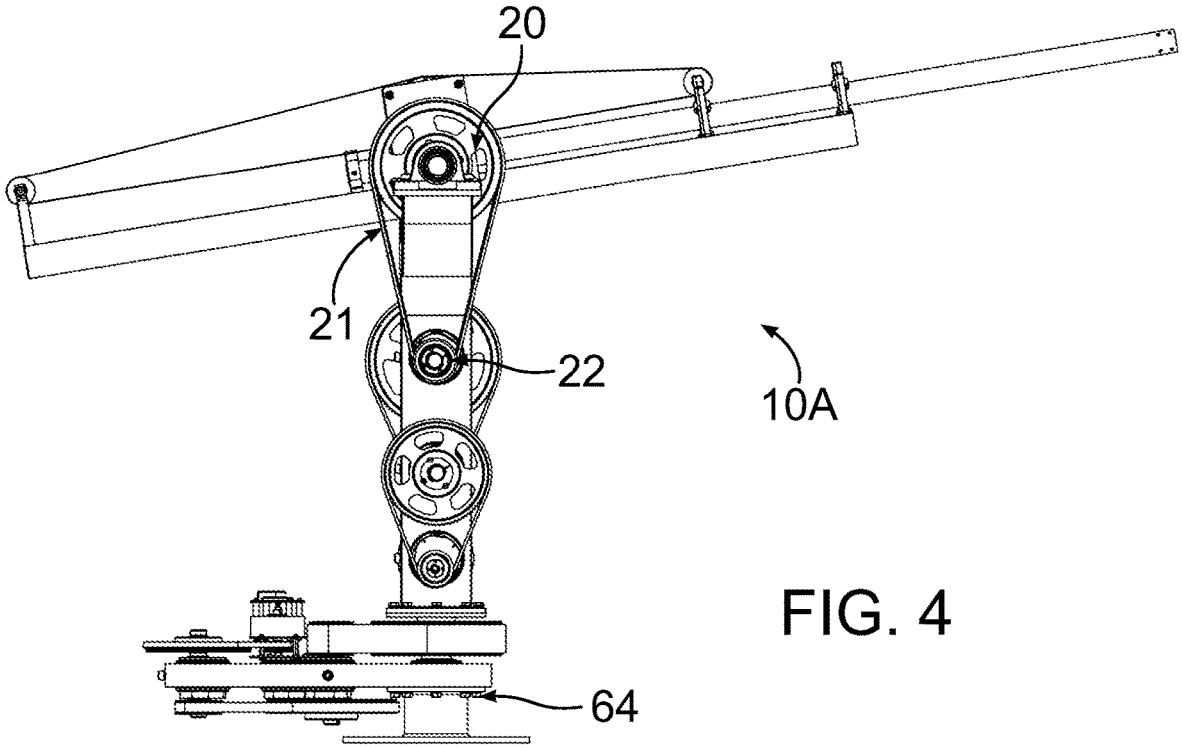
FIG. 4 is a side view of the exercise device.
Figure 5:
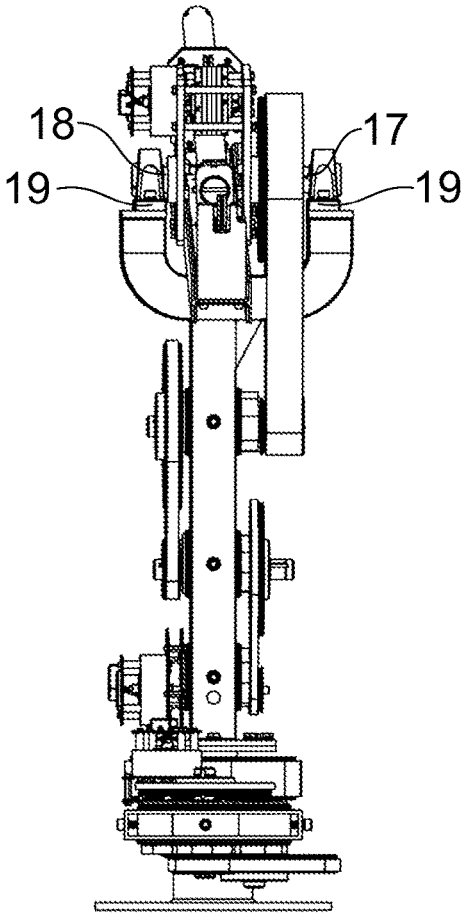
FIG. 5 is a rear view thereof.
Figure 6:
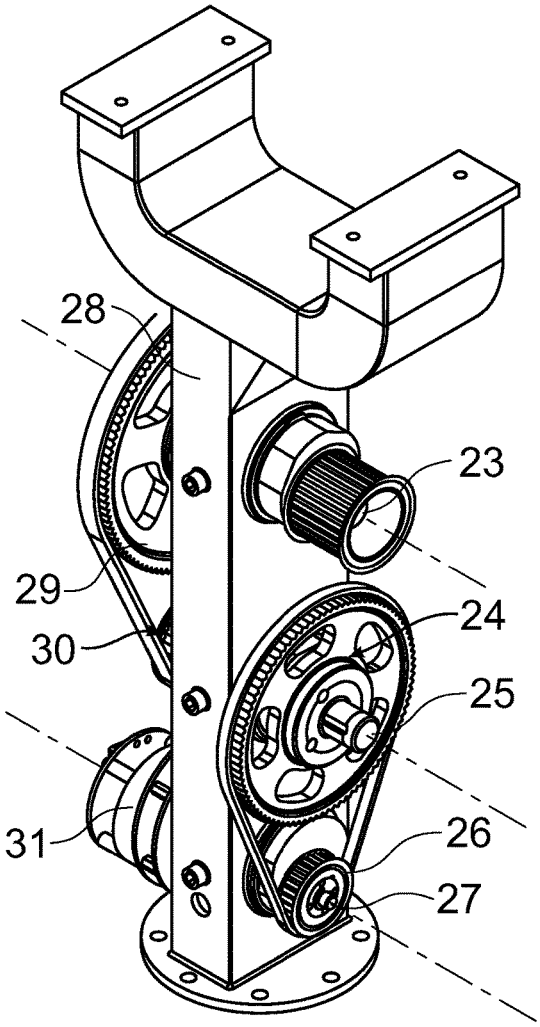
FIGS. 6-7 are perspective and edge views of the torso portion.
Figure 7:
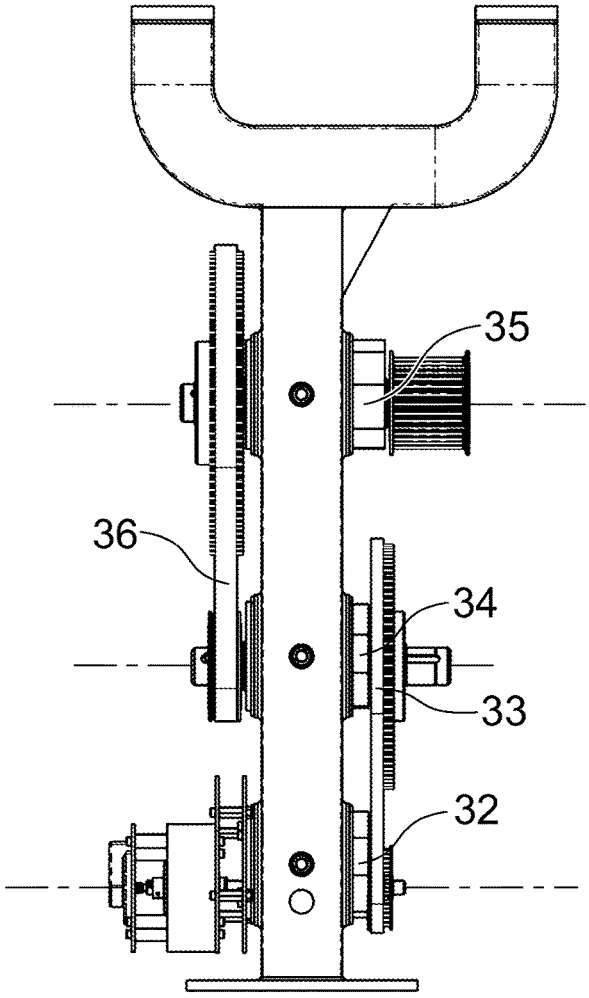
Figure 8:
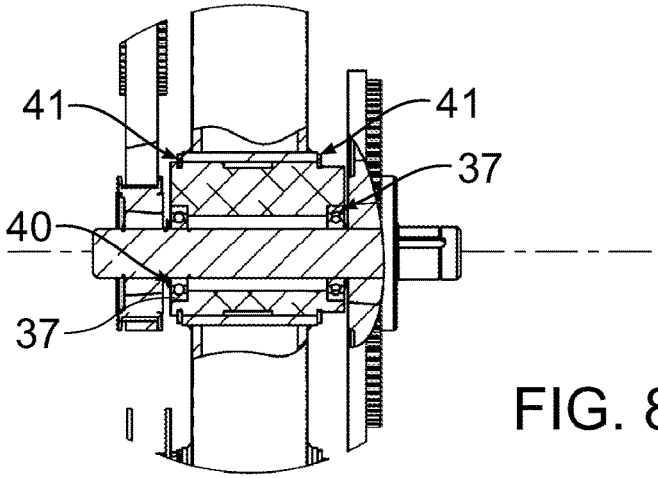

Referring to FIGS. 4 and 5, the linear motion stage (1) can be attached to the polar angular motion stage (2) through the use of two cantilever shafts (17, 18) mounted to the main support of (1), which sit inside of pillow blocks (19) on top of the angular motion stage (2). On one of the cantilever shafts (17) is a shaft mounted timing belt sprocket (20) that connects to a timing belt sprocket (22) on the angular motion stage (2) by way of a timing belt (21).

Referring to FIGS. 6-10 the angular motion stage (2) can consist of 3 shafts (23, 25, 27) that comprise a geartrain of timing belts and sprockets (24, 26, 33, 36, 29, 30). The geartrain can connect the linear motion assembly to a magnetic particle brake (31) and gear the velocity and torque to appropriate numbers for the brake to handle. Mounted to the rear side of the brake is an incremental encoder that can output the position data of the brake shaft to the processing computer. The shafts (23, 25, 27) can mount inside bearings (37), which can be mounted inside of elliptical bushings (38) that sit inside of holes in the main structure (28). The bushings (38) can be held inside the structure (28) by 2 external shaft clips (41) and rotation can be prevented by a screw (39). Additionally, there can be series of external clips and spring washers (40) on all shafts that are used to ensure preload on all bearings as well as correct positioning of sprockets. The elliptical bushings (38) can have bearing holes that are not concentric to the outer diameter, the reason for this being that as the elliptical bushing is turned, the distance from one shaft to another (25, 25, 27) will change and that will change the tension on the individual belts (33, 36, 21). Altering tension of belts can change the amount of backlash and minimum operating torque of the geartrain, and proper tensioning also ensures a long life of the belts. The elliptical bushings (38) can have flat spots machined in the outer surface such that the screw (39) can lock the bushing into place at the correct belt tension level.

The polar angular motion stage (2) can be connected to the azimuthal angular motion stage (3) by way of screws (42) connecting their flanges (FIG. 1).

Figure 11:
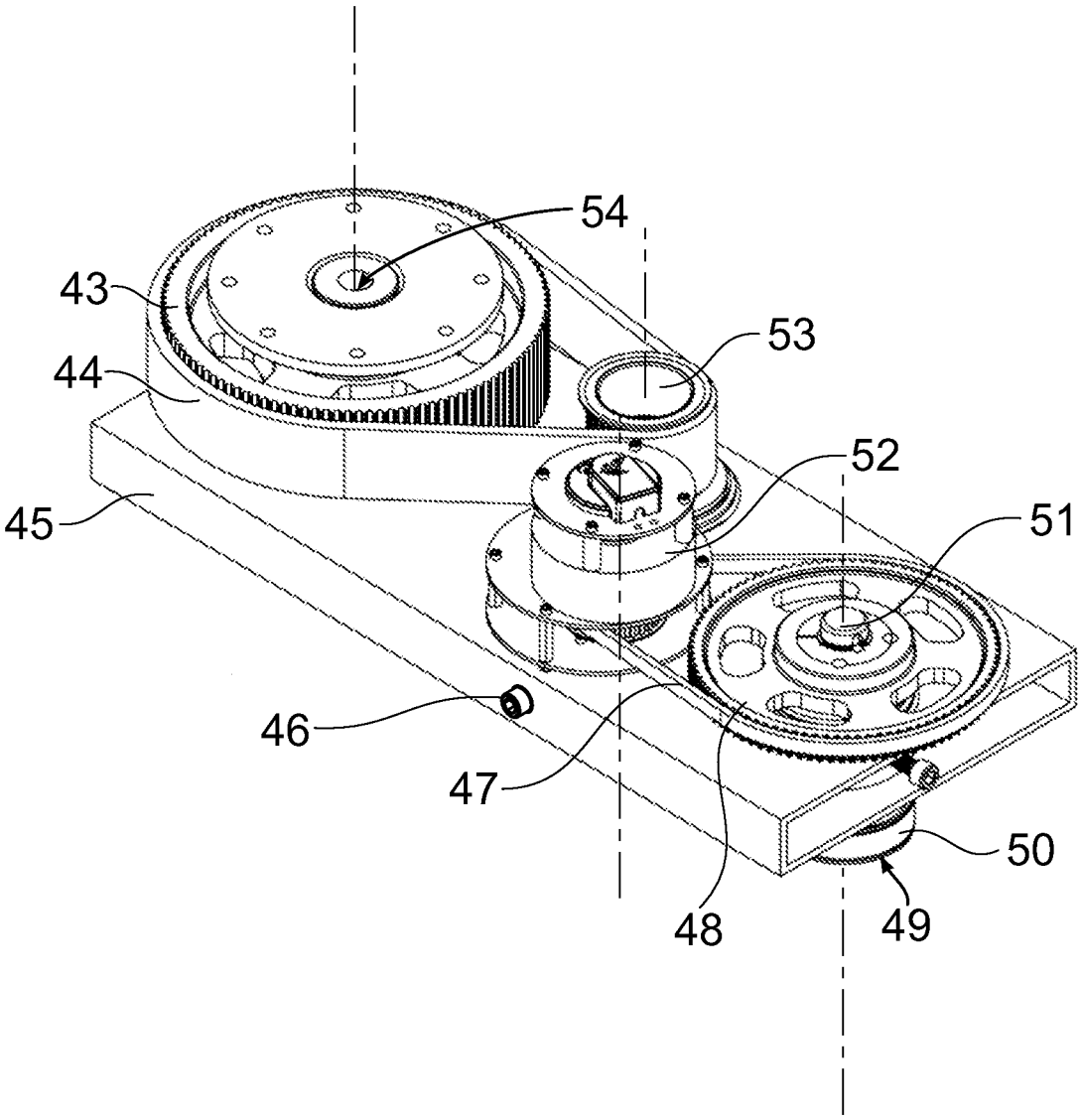
FIGS. 11-13 are perspective, top and side views of the base stage.
Figure 12:
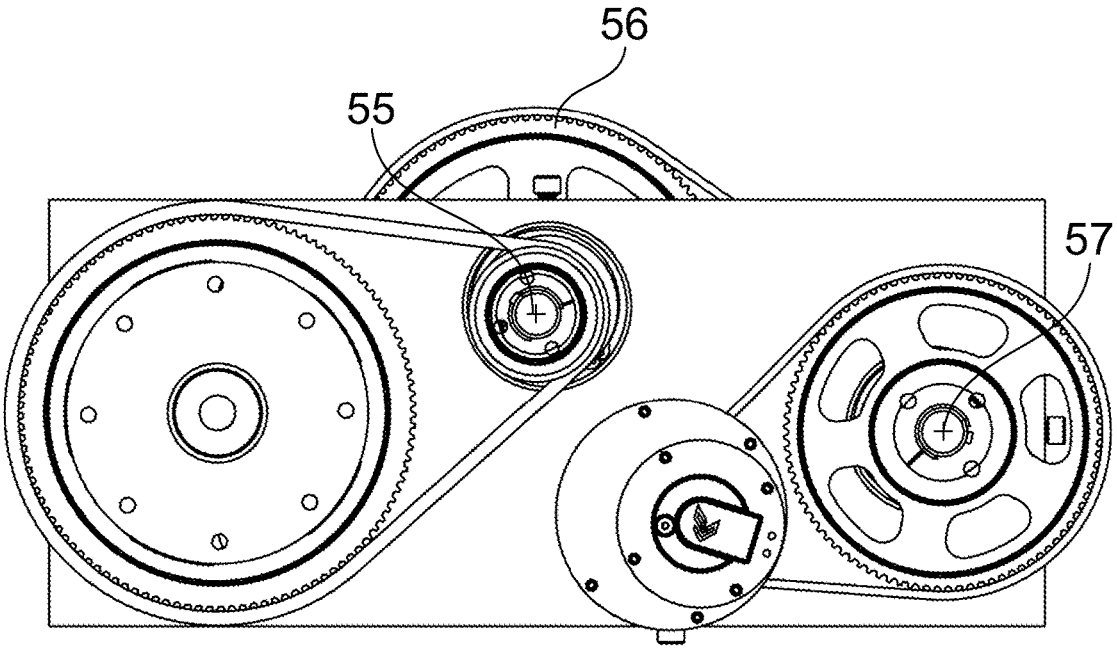
Figure 13:
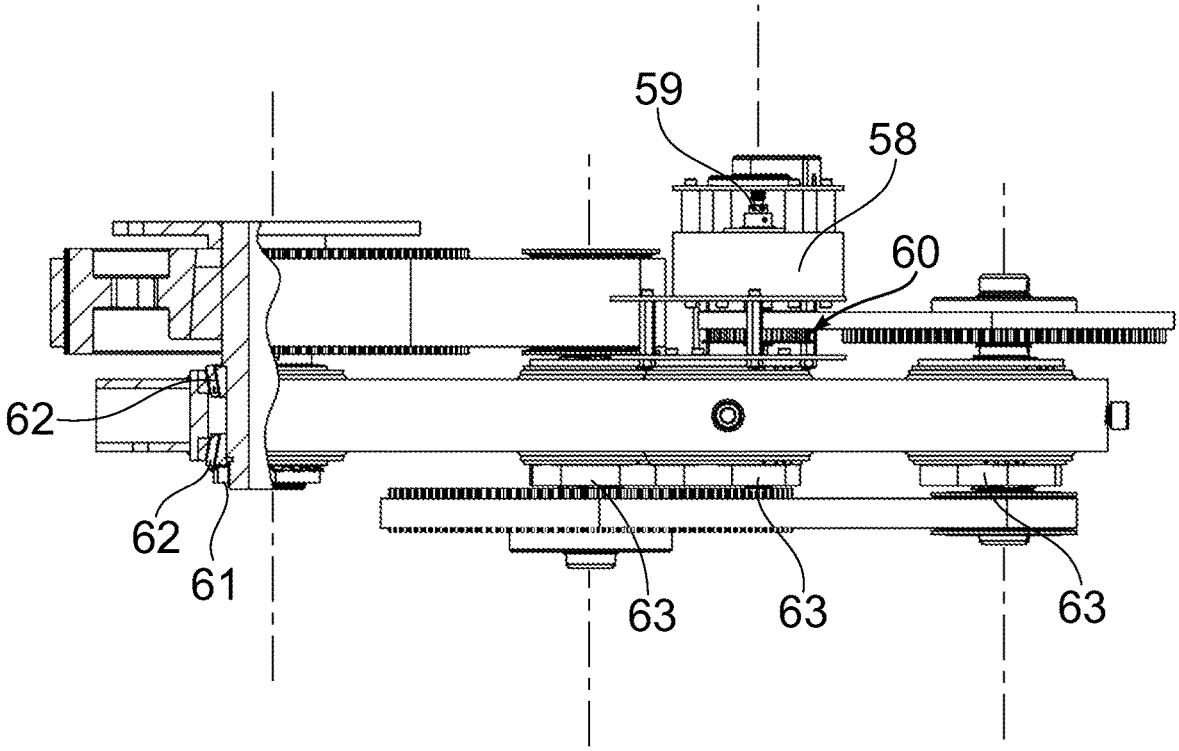

Referring to FIGS. 11-13, the azimuthal angular motion stage (3) can be set up very similarly to the polar angular motion stage (2). There can be shafts (54, 51, 57, 55), belts (44, 47, 50), sprockets (43, 53, 48, 49, 60, 56), elliptical bushings (63) and external clips holding most of the geartrain in place. This stage also can make use of a magnetic particle brake (58) with an incremental encoder for position and torque control. Unlike in the polar angular motion stage (2), the main shaft (54) in this stage can support the weight of the structure above it axially through the bearing, and for this reason the shaft (54) can be stepped and tapped so that two tapered roller bearings (62) can be used for additional axial support. The shaft and bearings can be held together by a locking bearing nut (61).

Figure 14:
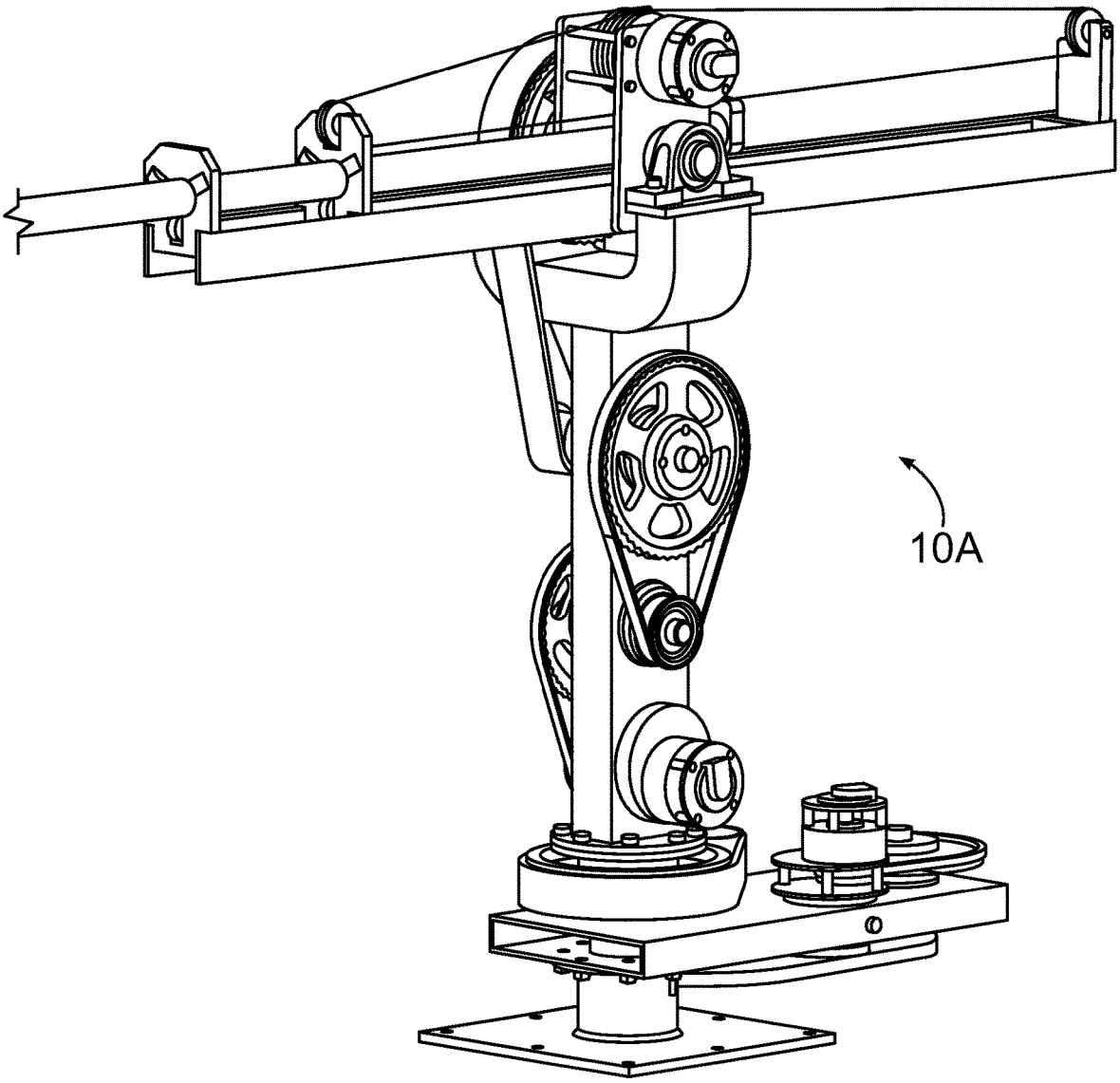
FIG. 14 is a perspective view of an embodiment of the exercise apparatus.
Figure 15:
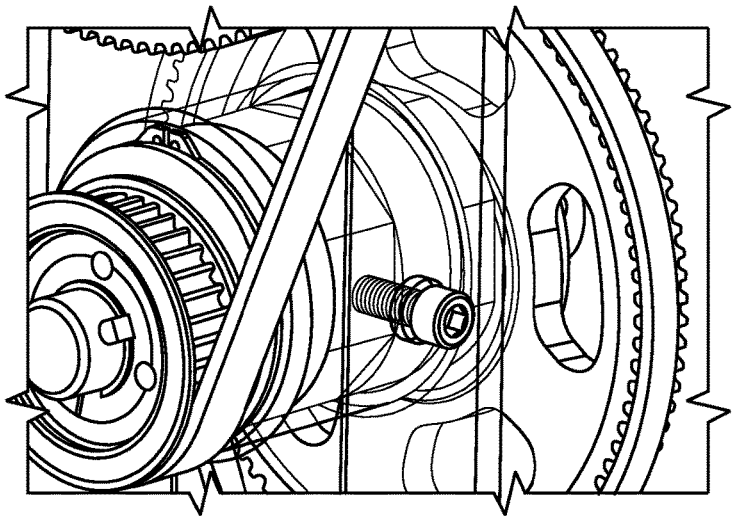
FIG. 15 is an enlarged view of a portion of the transmission on the torso portion.

Removable base (4) can attach to the azimuthal angular motion stage (3) through screws (64), as seen in FIG. 4. The base has mounting holes that allow the base, and thus the entire assembly, to be hard mounted to a floor (FIGS. 1 and 14). The base can be replaced with other embodiments that allow the assembly to be mounted to different types of floors, or to be self supporting without the need for floor mounting screws.

Other Embodiments

This system can meet ASTM safety factor guidelines (6× on structural parts, 4× on other mechanical parts) for commercial fitness placement, when other markets (medical, physical rehab, at-home/consumer fitness) are targeted, the safety factor can be reduced, thereby reducing the size of many large structural and non-structural parts (e.g. the welded steel frame dimensions; the size of the OTS pulleys and belts). This can further reduce the cost, size (visual and physical), and weight of the system.

ID load requirement reduced, the safety factor also can be reduced, and the changes above apply as well.

Other suitable types of sensors.

Brake on the back of the linear stage.

Linear stage flipped upside down.

Reducing stroke/linear length.

Different belt types.

Adding motor.

System can be free standing instead of bolted to the floor—floor stand swaps out for legged system.

Figure 16:
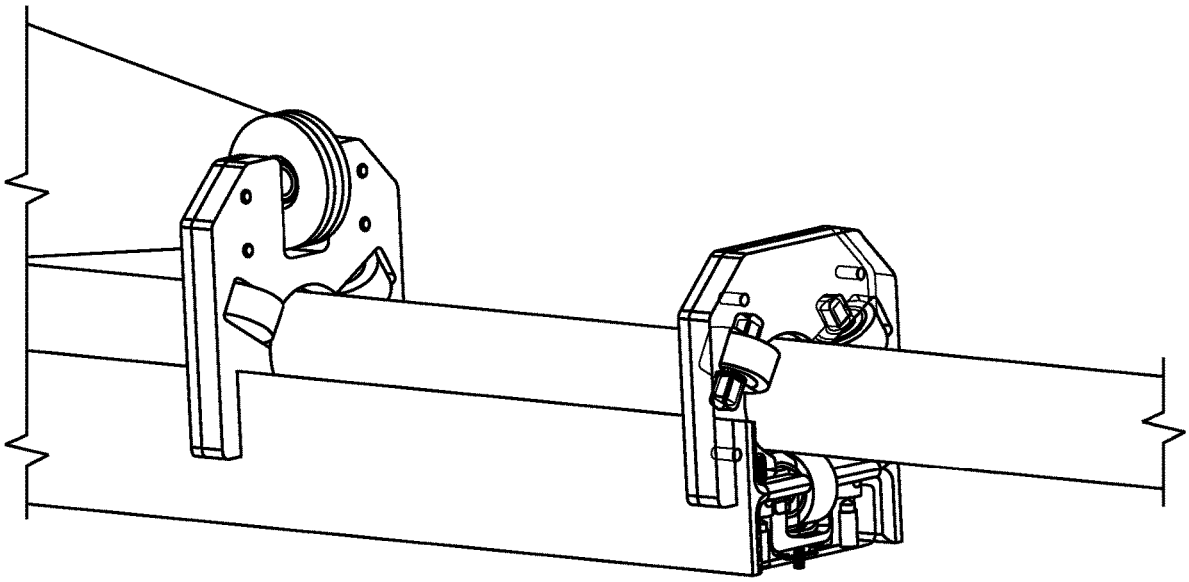
FIG. 16 is an enlarged perspective view of the two roller assemblies on the linear arm portion.

FIG. 16 shows more detail of the linear stage front including two front stops with rollers.

Figure 17:
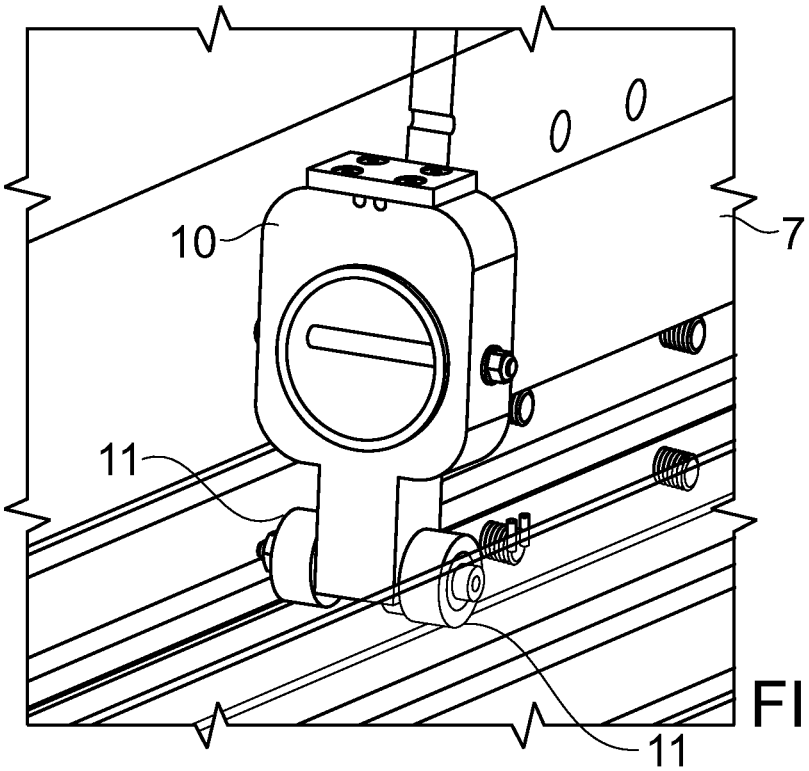
FIG. 17 is an enlarged perspective view of the proximal end of the arm member.

Referring to FIG. 17, the tube stopper 10 and rollers 11 can allow lateral or orthogonal movement of the proximal end of the tube or arm member 7 relative to axis $A_1$ during exercise and can also serve as a bumper system to eliminate contact of the tube with other structural parts, especially in travel. The rollers are not meant to be in contact with the rail support at all times. The rollers 11 can be spaced from the rail and contact when forced downwardly. The tube 7 can move a further distance in the lateral or upward directions.

Figure 18:
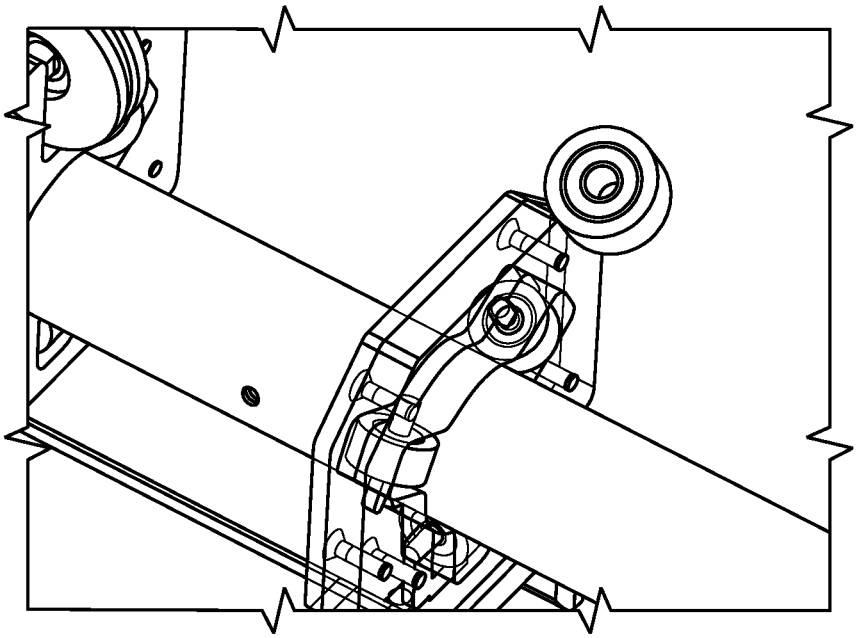
FIG. 18 is an enlarged perspective view of an embodiment of a roller assembly on the linear arm portion with larger rollers.

Referring to FIG. 18, larger diameter rollers can be used on the front stop to meet required safety factor and to prevent extra wear. This can result in a larger front stop.

Figure 19:
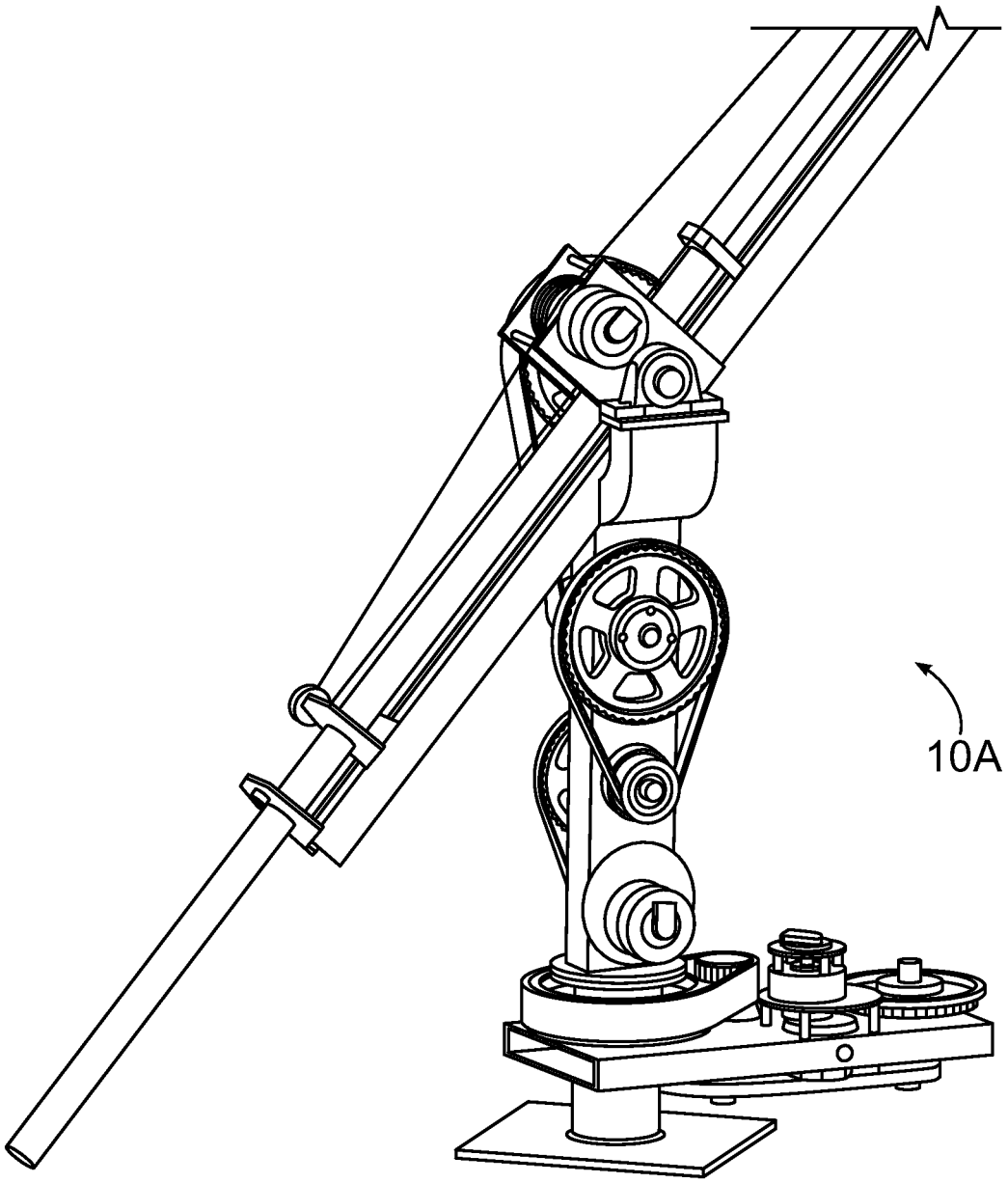
FIGS. 19-22 are perspective and side views of embodiments of exercise apparatuses in the present invention.

Referring to FIG. 19, the range of motion of turret (up down) can slightly be reduced to avoid contact with welded steel frame, without adding extra height to the top "forks" of the frame or torso portion 2.

Figure 20:
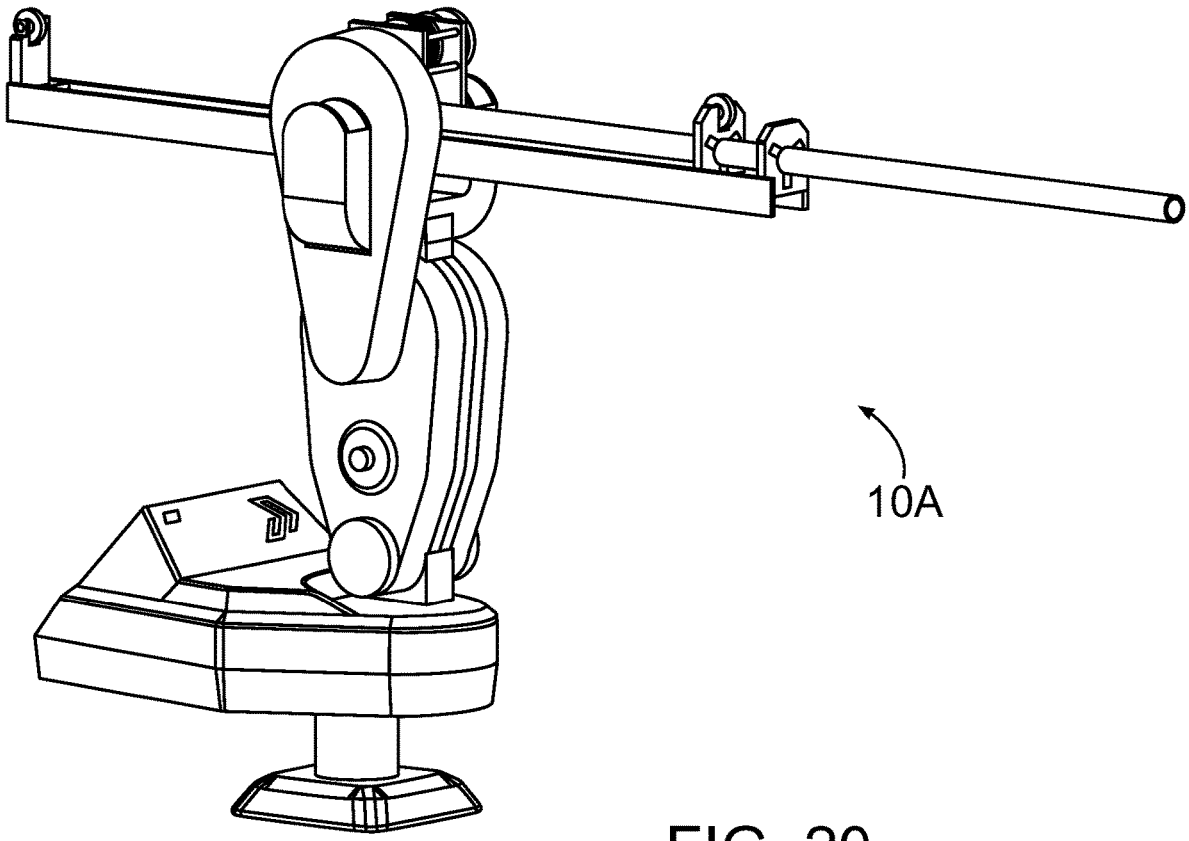
Figure 21:
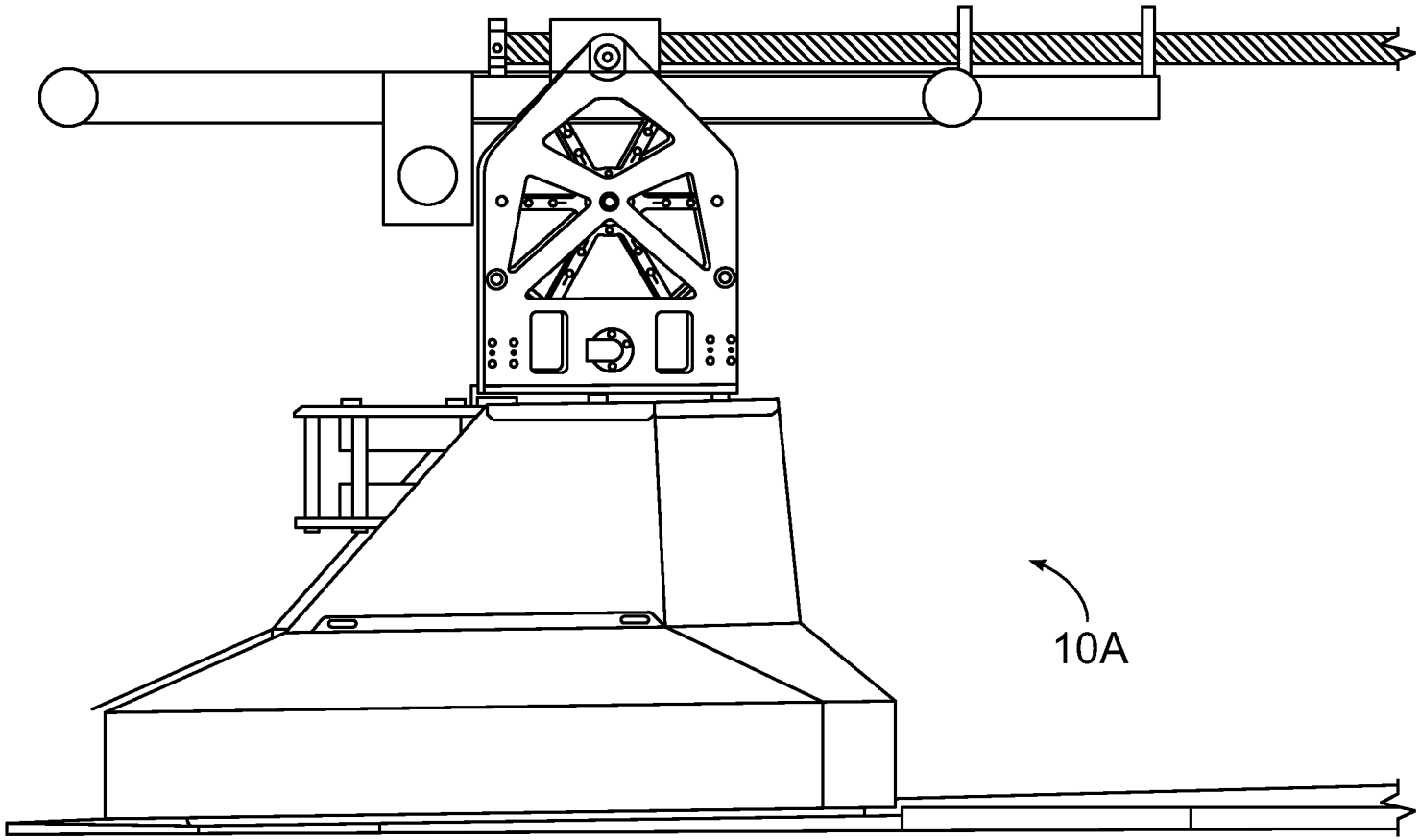
Figure 22:
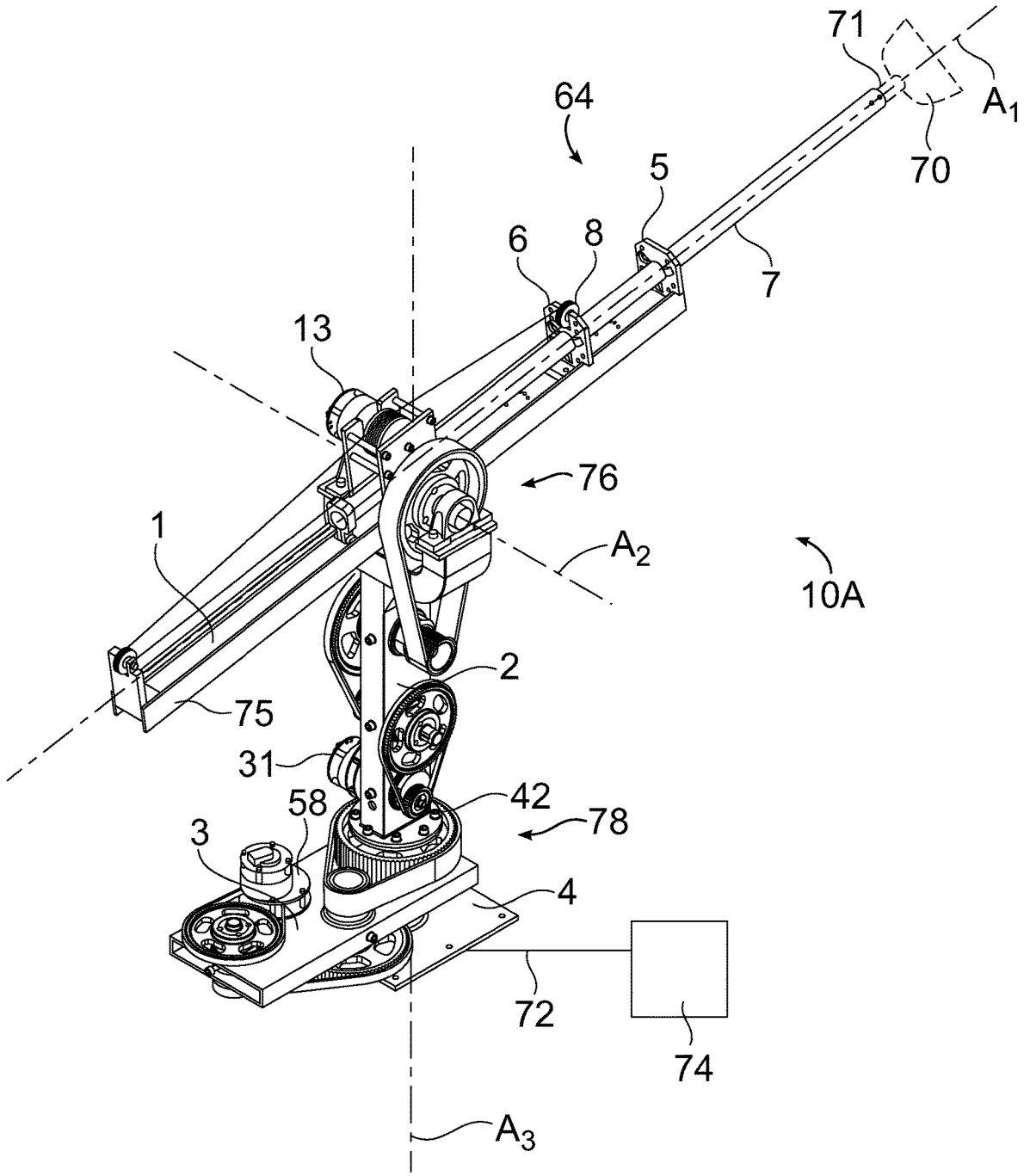
Figure 23A:
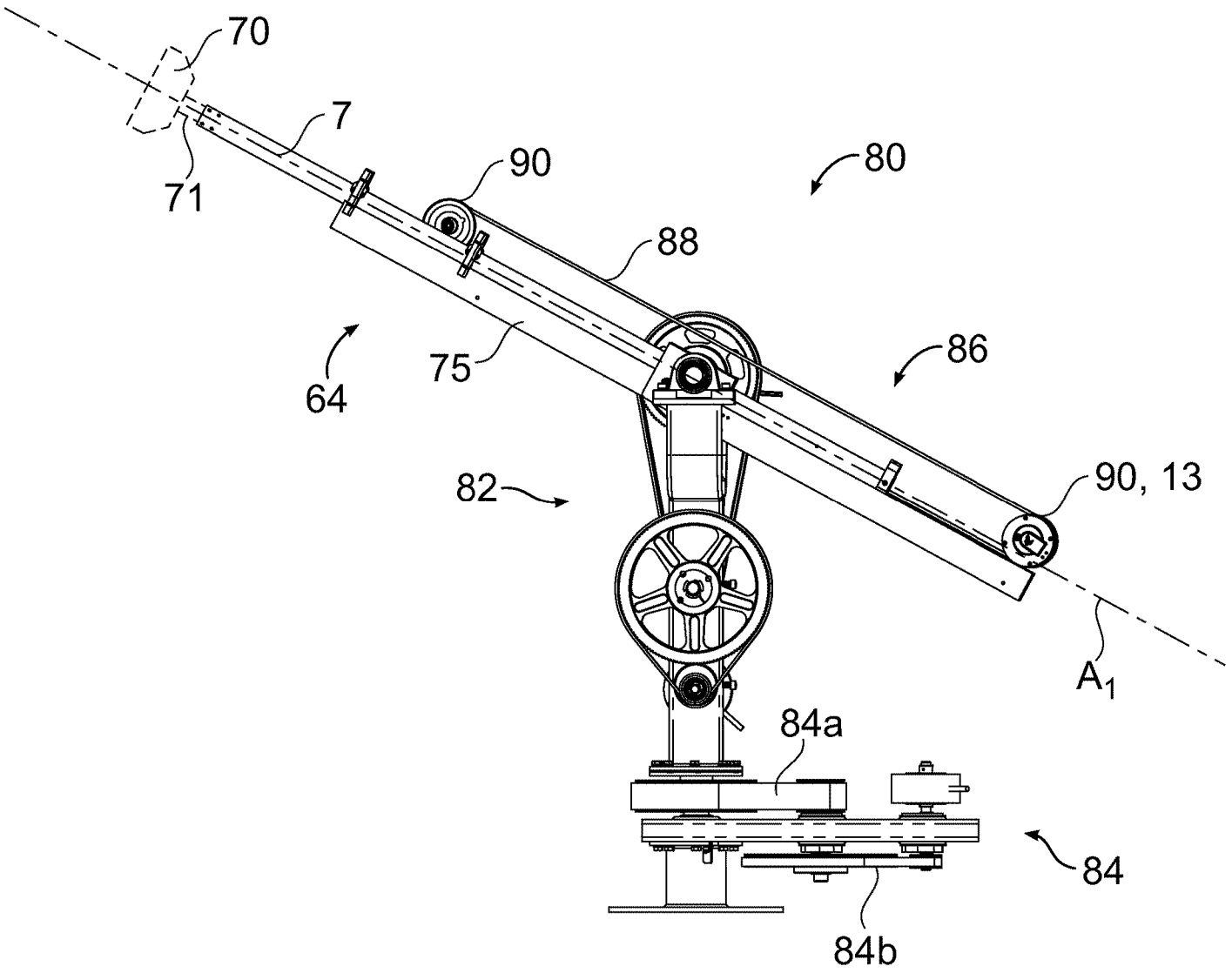
FIGS. 23A-23C are side and rear views of another embodiment of an exercise apparatus in the present invention.
Figure 23B:
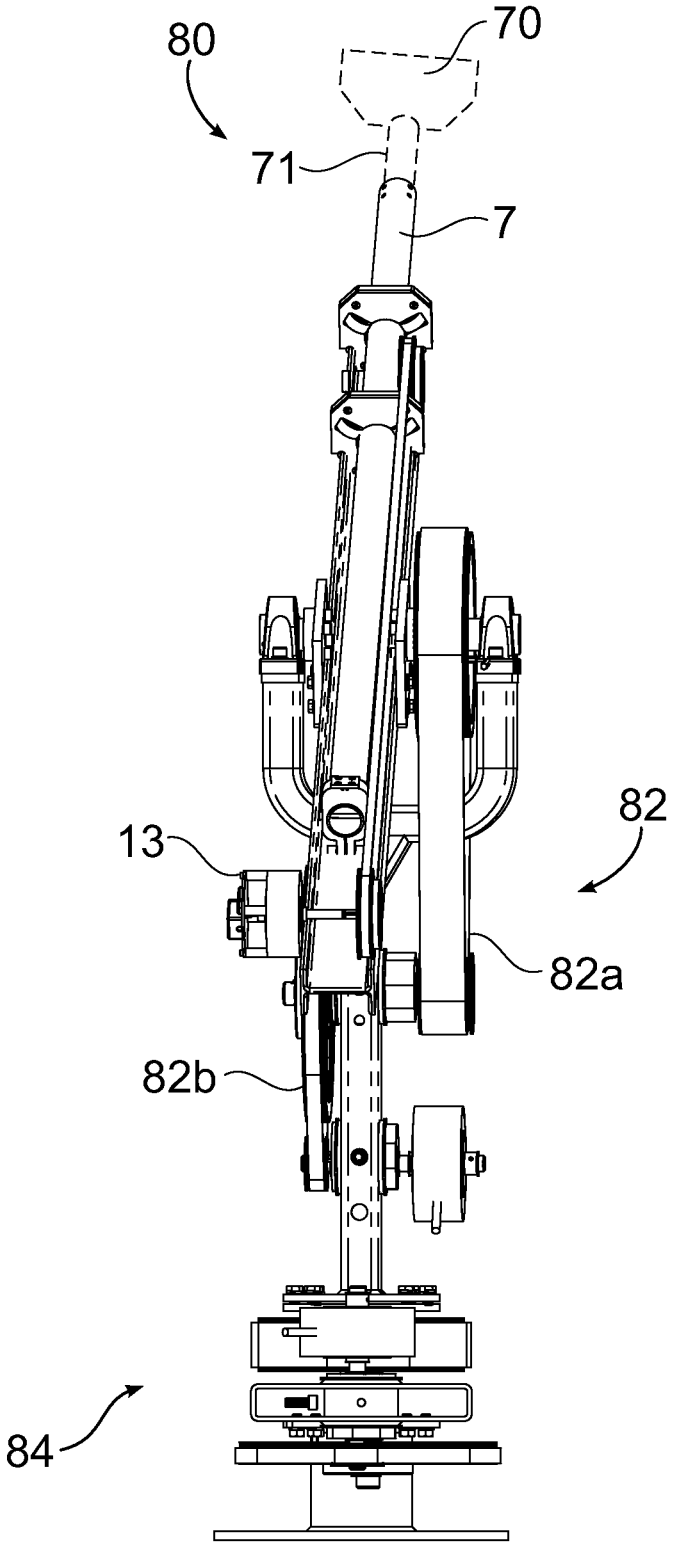
Figure 23C:
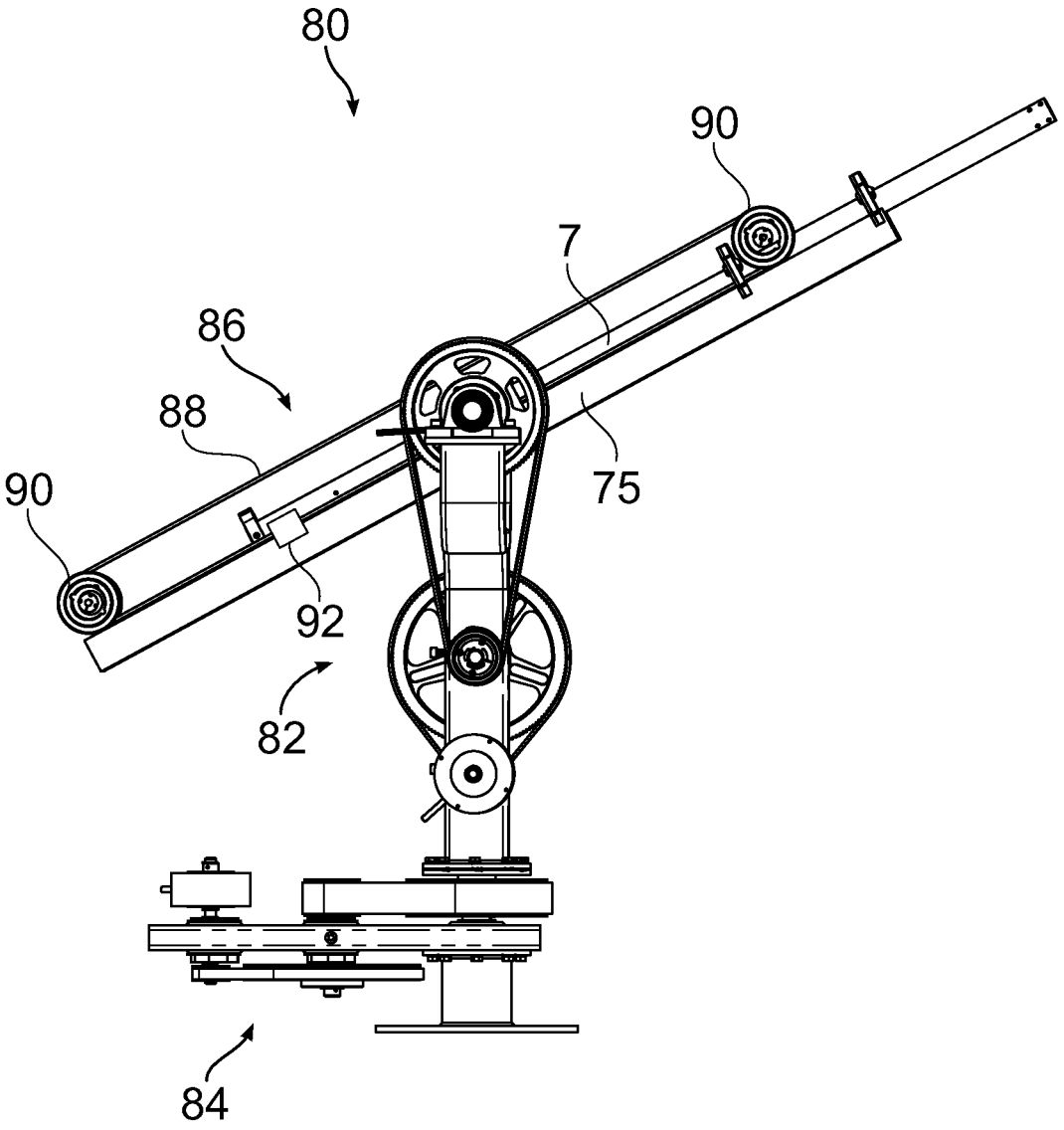
Figure 26:
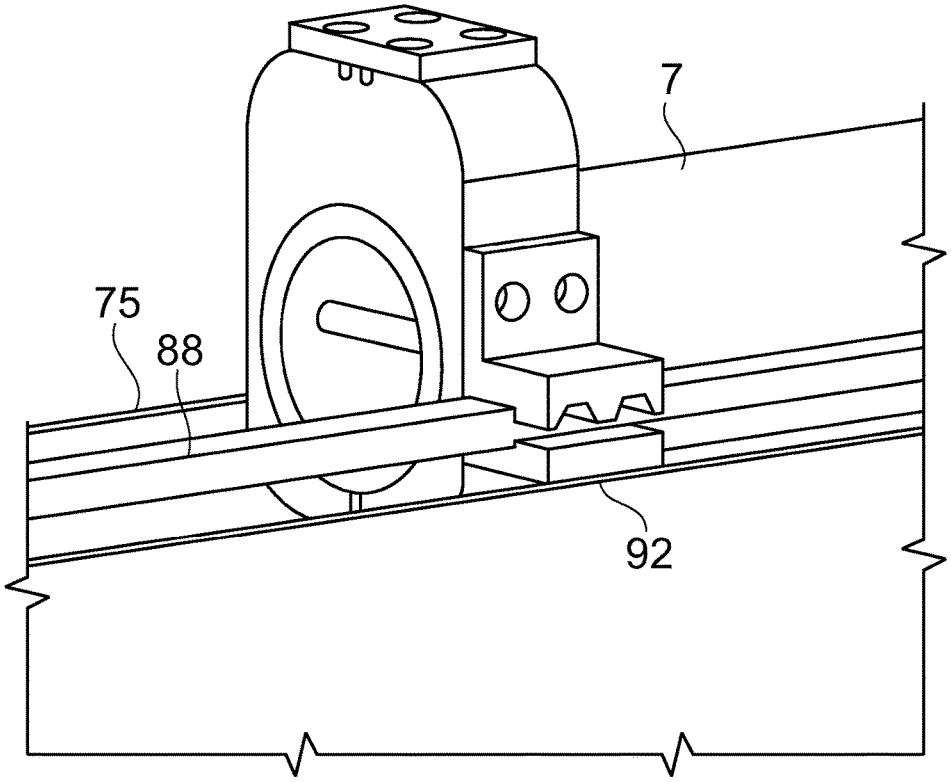
Figure 27:
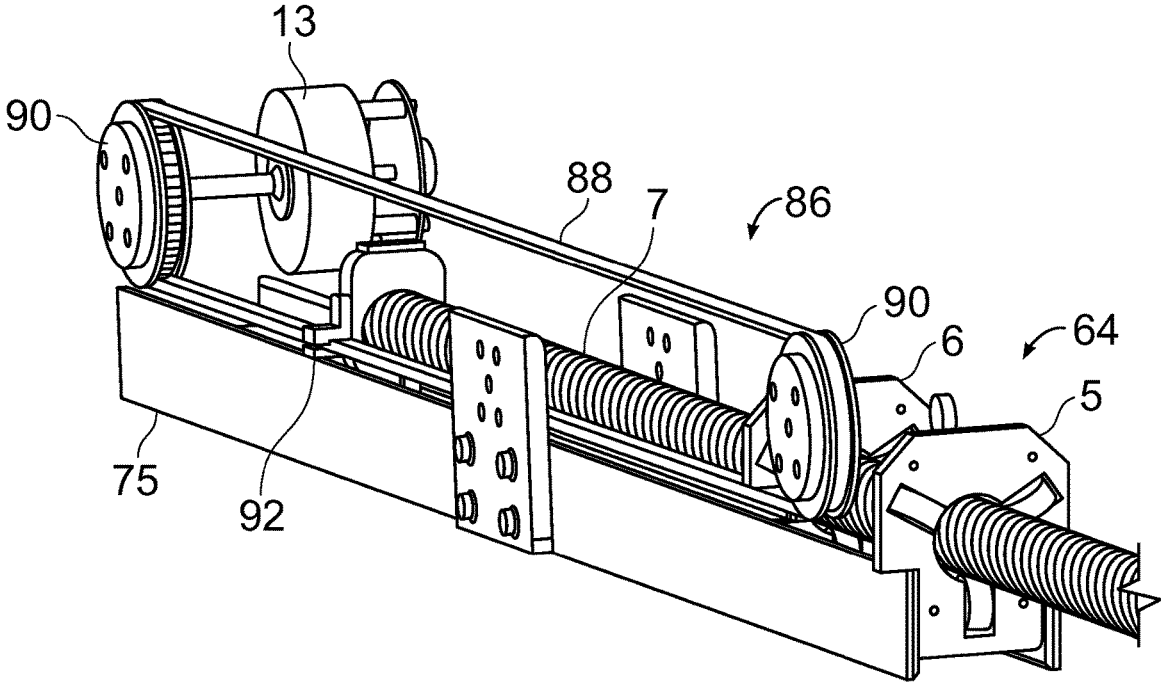
Figure 28:
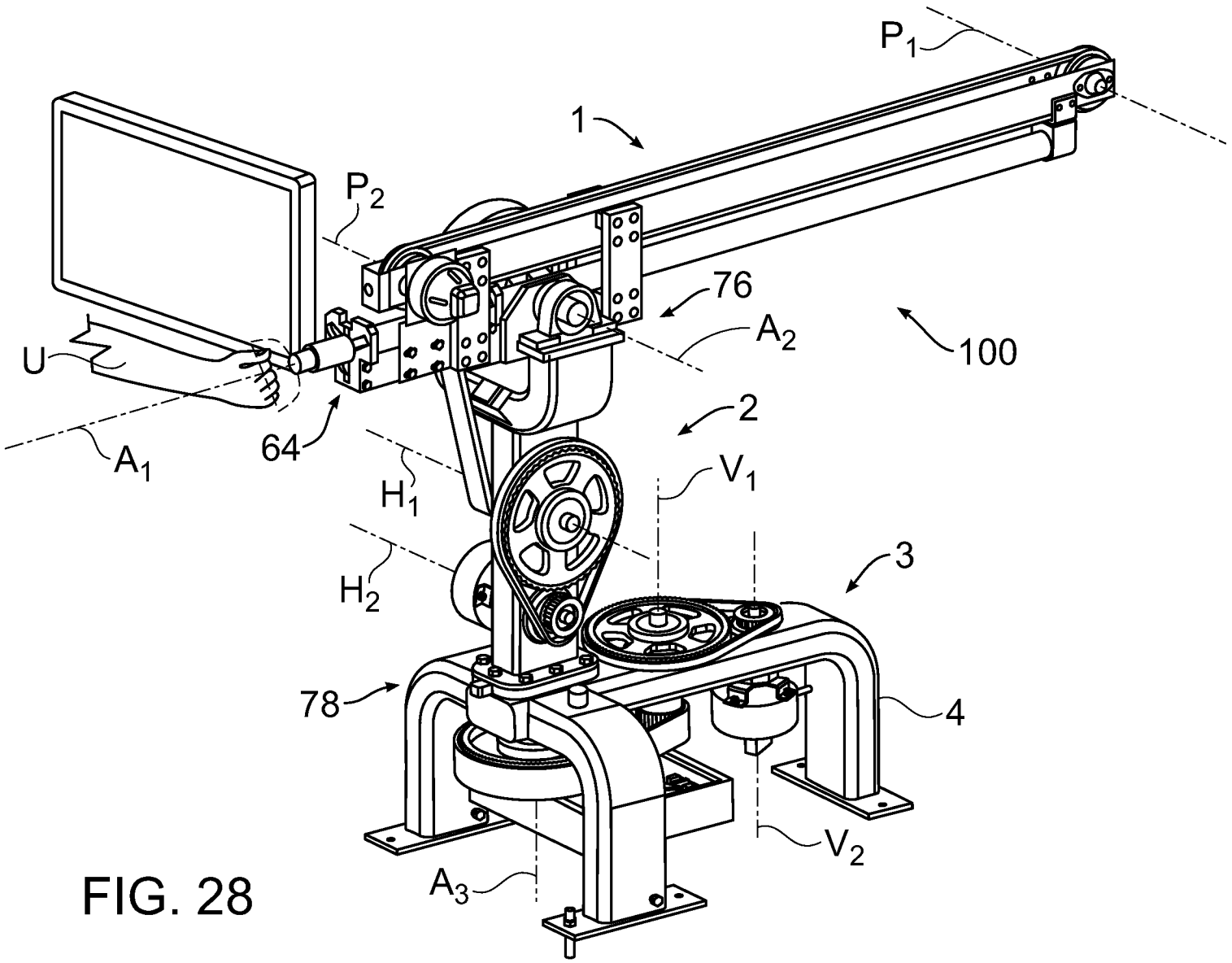
FIGS. 28-29 are perspective views of another embodiment of an exercise apparatus in the present invention.

FIGS. 20 and 21 depict embodiments of exercise apparatuses with protective covers over at least some of the moving parts. FIG. 21 shows that the size and materials can be smaller and lighter weight to reduce inertia loads.

Referring to FIGS. 28-35, exercise apparatus 100 is another embodiment in the present invention and includes a linear arm portion 1 rotatably coupled to a torso portion or polar angular motion stage 2, that in turn is rotatably coupled to a base, waist or azimuthal angular motion stage 3. The linear arm portion 1 can include a limb interface device or handle 70 that can be engaged by a limb or hand of the user U for exercise, which can include complex resistive movements or motions with six degrees of freedom. The linear arm portion 1 can allow or provide resistive bi-directional reciprocating or translating linear motion or movement of arm member 7 along axis $A_1$ relative to the support member 75, as indicated by arrows L. The shoulder joint 76 can allow or provide resistive bi-directional reciprocating rotary motion of the linear arm portion 1 relative to the torso portion 2 about axis $A_2$ in the direction of arrows S. The waist joint 78 can allow or provide resistive bi-directional reciprocating rotary motion of the torso portion 2 relative to the base stage 3 about axis $A_3$ in the direction of arrow's W. Embodiments of exercise apparatus 100 can differ from the embodiments in FIGS. 1-27 in that instead of positioning the rotary shoulder joint 76 and axis $A_2$ on the linear motion portion or stage 1 at about midway along the length of the support member 75, the rotary shoulder joint 76 and axis $A_2$ can be positioned near the distal end of the support member 75 (FIGS. 28 and 29), and can be inwardly a distance d (FIG. 31E) from the distal end about ¼ to ⅓ (for example ²⁄₇) the length of the support member 75. This reduces the length of the moment arm M of arm member 7 at the distal end or handle 70 relative to the shoulder joint 76 and axis $A_2$ and/or axis $A_3$ when the arm member 7 is fully extended from the support member 75. Such a reduction in the moment arm length reduces forces exerted on apparatus 100, and allows a reduction in the gear ratios and size of the transmissions required to generate the required resistances or resistive forces, as well as the size and weight of the structural components, thereby reducing inertia.

Referring to FIGS. 29-32, the linear arm portion 1 can have a support member 75 including an upper or first support portion 75*a*. A lower or second support portion 75*b* can be secured to the upper support portion 75*a* below or under portion 75*a*, forming the distal end of the support member 75, and extending therefrom. The lower support portion 75*b* can have a lateral or longitudinal portion 77*a* and four securement brackets or members 77*b* that secure to the upper support portion 75*a* such as by fasteners or screws. The roller or bearing assemblies 5 and 6 of the sliding joint 64 can be mounted to the lower support portion 75*b* at the distal end of the support member 75. The upper support portion 75*a* can have two timing belt pulleys 90 mounted between two lateral side members at opposite longitudinal ends of the upper support portion 75*a* along axes $P_1$ and $P_2$. The lateral side members can be connected together at the ends. Arm brake 13 can be coupled to the pulley 90 at the distal end of the upper support portion 75*a* along axis $P_2$. The timing belt 88 of the linear arm brake assembly 86 can be secured to the proximal end of the arm member 7 by a connecting member 92, such as a clamp or bracket, to provide bi-directional linear motion resistance or resistive force to the arm member 7 from arm brake 13. The connecting member 92 can also be secured to a carriage 106 that can have rollers, bearings or wheels spaced away or apart from surfaces of the upper support portion 75*a* with a predetermined gap such as about 0.01 inches, to allow the proximal end of the arm member 7 to have some unconstrained lateral or orthogonal movement relative to linear axis $A_1$ (side to side and/or up and down). Under extreme forces and twisting motions, the arm member 7 can bend and the rollers of the carriage 106 can engage surfaces of the upper support member 75*a*. By providing the proximal end of arm member 7 with some level of unconstrained lateral or orthogonal movement or play relative to axis $A_1$, friction forces for linear movement of the arm member 7 relative to support member 75 can be kept to a minimum. The carriage 106 can have rollers 106*a* for engaging lateral surfaces or sides of the upper support portion 75*a*, and rollers 106*b* for engaging lower surfaces or sides of the upper support portion 75*a* during bending. This can form a loose fit sliding joint that engages only during certain levels of bending, and can act as an intermittent sliding joint only when support is needed.

The roller or bearing assemblies 5 and 6 that form the sliding joint 64 along axis $A_1$ can be similar to that in the embodiments of FIGS. 3 and 18 having a member 65 with a hole or openings 65*a* extending therethrough. Three equally spaced rotatable rollers, wheels or bearings 15 are positioned around the opening 65*a* for equal radial engagement of the arm member 7, and can be adjusted with the adjustable mount 16 associated with one roller 15 such as at the bottom. The arm member 7 can move along axis $A_1$ which can intersect axis $A_2$. The roller bearing assemblies 5 and 6 can be secured to the longitudinal portion 77*a* of the lower support portion 75*b*, and can be spaced apart from each other by about ⅙ to ⅐ the length of support member 75 or about 12 inches.

Figure 33:
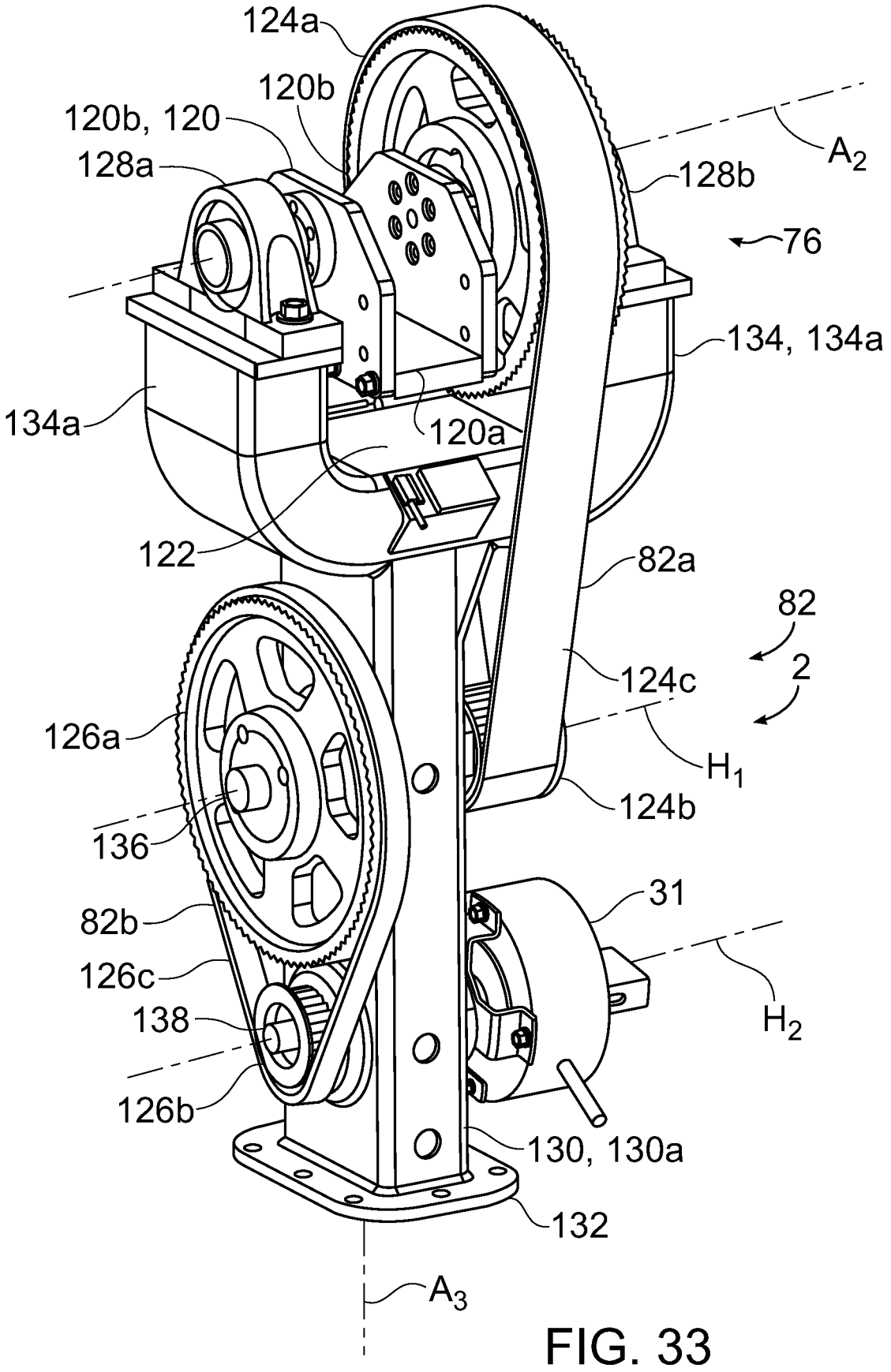
FIG. 33 is a perspective view of an embodiment of a torso portion.

The longitudinal position of the distal end pulley 90 can be adjusted relative to the upper support portion 75*a* by a pulley or belt adjustment or tension arrangement, device, apparatus or mechanism 79 (FIG. 33). The adjustment device 79 can have an adjustable bracket 79*a* within which the pulley 90 is rotatably mounted along axis $P_2$. An adjustment screw 79*c* extends through end member 79*b* along axis 79*d* to engage the adjustable bracket 79*a* and adjust the position of pulley 90 and the tension of belt 88. The pulley 90 can be secured to the upper support portion 75*a* by mounting brackets 90*a* with screws 81*a* and slotted holes 81*b*. The arm brake 13 can be rotatably coupled to the pulley 90 by a transmission, drive or brake shaft 13*a*. The arm brake 13 can be mounted to a mounting bracket 77*c* that is secured to and extending upwardly from the lower support portion 75*b*. The pulleys 90 and belt 88 can be longitudinally positioned parallel to and in spaced alignment with axis $A_1$.

Figure 29:
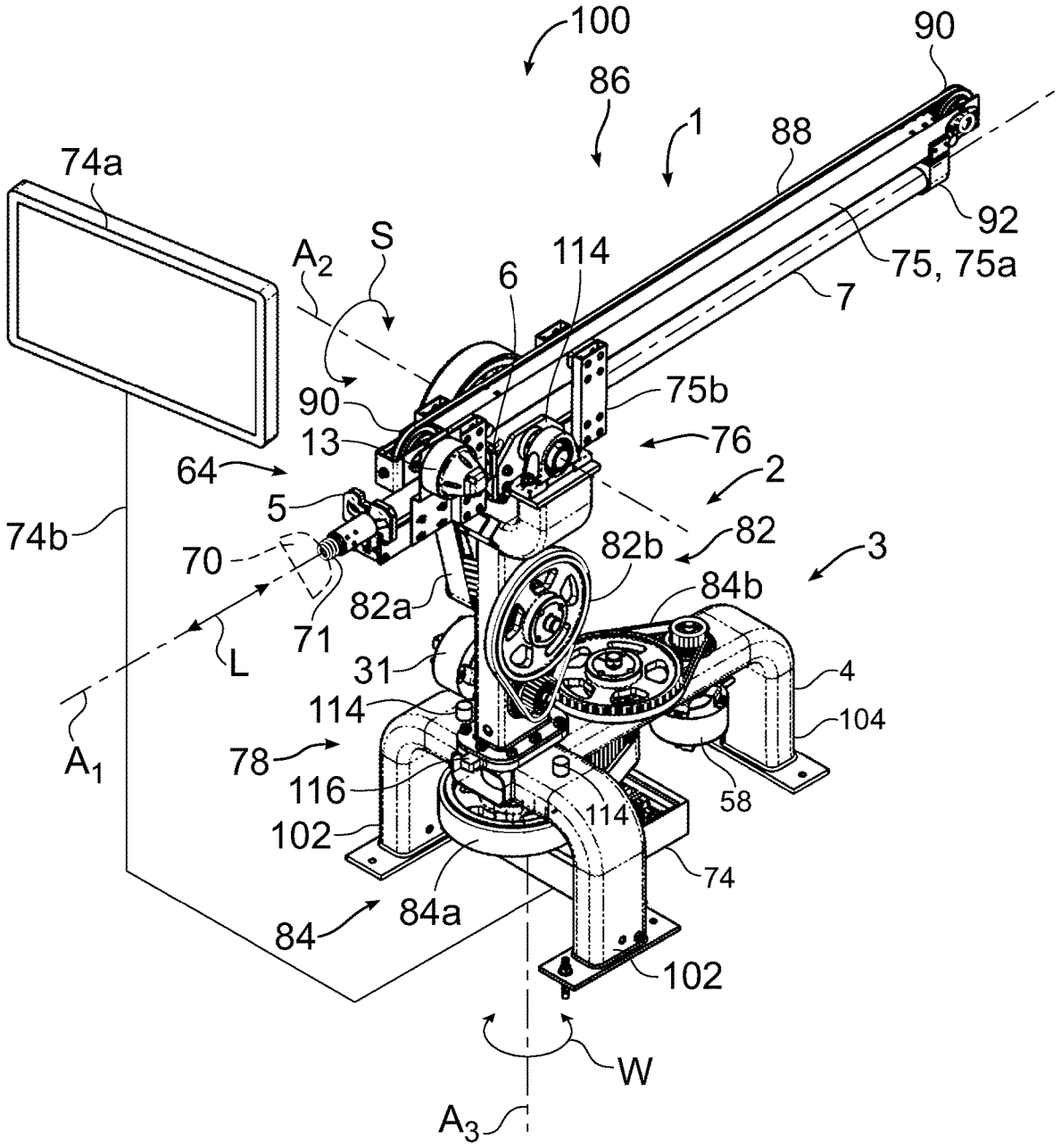
Figure 30:
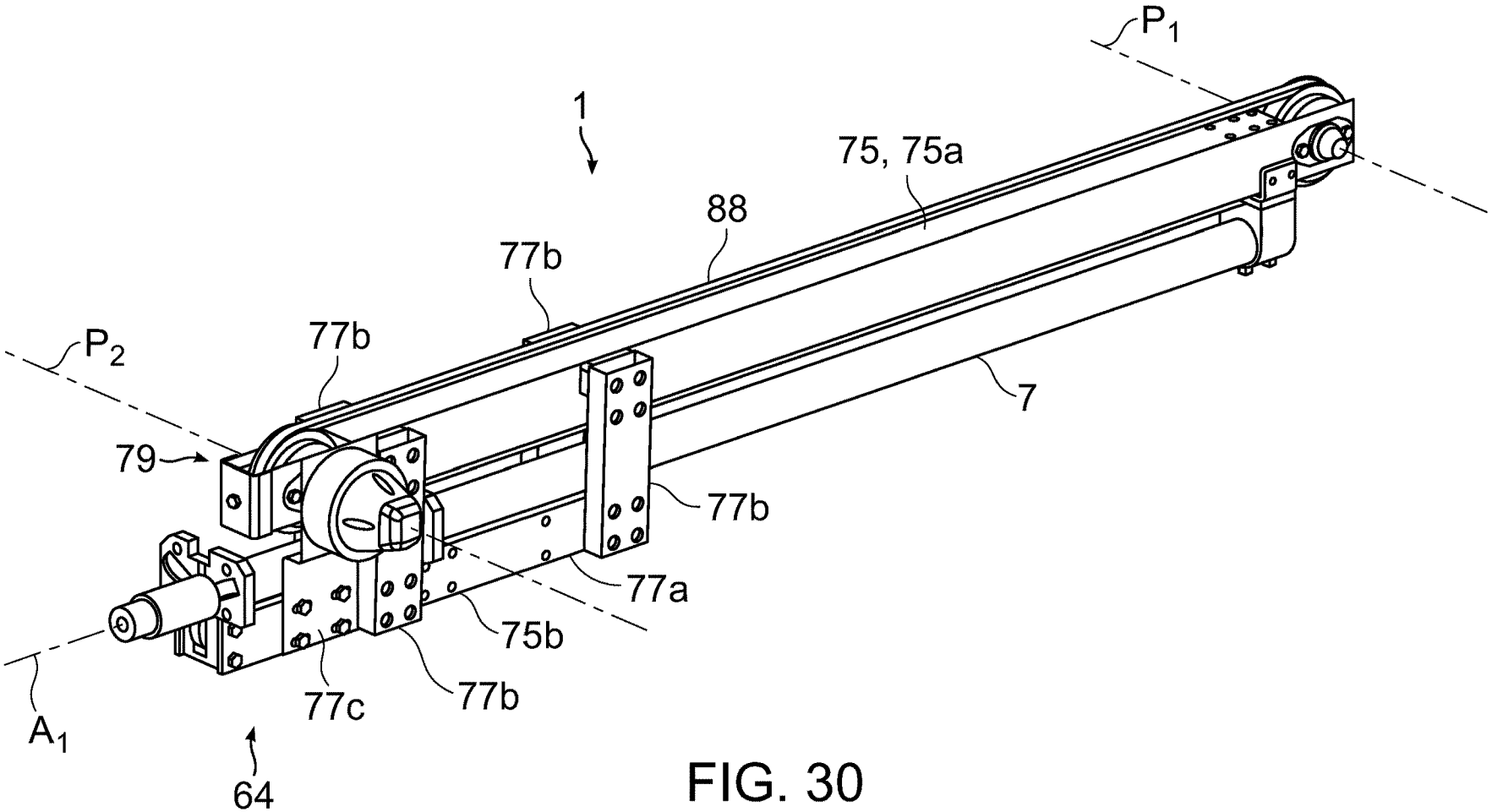
FIGS. 30, and 31A-31E are perspective, side, sectional and end views of an embodiment of a linear arm portion.

Referring to FIGS. 29 and 33, the lower support portion 75*b* of the support member 75 and linear motion portion 1 can be attached, connected, fastened, secured or fixed to the shoulder joint 76 by a linear arm mounting bracket or cradle 120 that is rotationally secured or coupled to the upper or large pulley 124*a* of the first pulley transmission stage 82*b* of the shoulder brake transmission 82 along axis $A_2$. The cradle 120 can have a short three sided generally channel shaped design, with a bottom portion 120*a* on which the lower support portion 75*b* seats, and two upright side portions or sides 120*b* which secure to the sides of the lower support portion 75*b* with fasteners such as screws through holes. As a result, the linear position of the support member 75 is fixed relative to axis $A_2$. One side 120*b* of the cradle 120 is secured to a bearing 128*a* with fasteners such as screws for rotation about axis $A_2$, and the other side 120*b* is secured to the pulley 124*a* similarly for rotation about axis $A_2$. The pulley 124*a* is rotatably supported along axis $A_2$ on the opposite side by bearing 128*b*. The cradle 120 is secured to the linear motion portion 1 between the brackets 77*b* of the lower support portion 75*b*.

The torso portion 2 can include an upright central support member 130 extending along axis $A_3$ having an upright column portion 130*a*, a bottom mounting flange 132 for mounting to the rotatable flange 140 of the base, waist or azimuthal motion stage 3 with screws through holes, and an upper mounting fork 134 with spaced apart upright arms 134*a* to which the bearings 128*a*/128*b* are mounted on upper surfaces. As a result, the timing pulley 124*a* of the first pulley transmission stage 82*a* of shoulder brake transmission 82 is rotatably supported between the arms 134*a* of fork 134. The first transmission stage 82*a* includes a timing belt 124*c* that engages the large pulley 124*a* and a small timing pulley 124*b* rotatably mounted to one side of upright column portion 130*a* below the fork 134 about horizontal axis $H_1$. The small pulley 124*b* of the first transmission stage 82*a* is rotatably coupled to the large timing pulley 126*a* of the second pulley transmission stage 82*b* located on the opposite side of column portion 130*a* by a transmission or driveshaft 136 extending along axis $H_1$ laterally through the column portion 130*a*. The second transmission stage 82*b* includes a timing belt 126*c* that engages the large pulley 126*a* and a small timing pulley 126*b* rotatably mounted to the column portion 130*a* below the large pulley 126*a*. The small pulley 126*b* of the second transmission stage 82*b* is rotatably coupled to the shoulder brake 31 located on the opposite side of column portion 130*a* by a transmission, drive or brake shaft 138 extending along horizontal axis $H_2$ laterally through the column portion 130*a*. As a result, the shoulder brake 31 is located on the same side of the support member 130 as the first transmission stage 82*a*. The shoulder brake 31 and the shoulder brake transmission 82 can provide bi-directional rotary or rotational resistance or force against the rotation or rotary movement of the linear arm portion 1 and/or shoulder joint 76 about axis $A_2$ relative to torso portion 2. Positioning components of the shoulder brake transmission 82 on opposite sides of support member 130 and axis $A_3$ can provide some rotational inertial balancing for rotation of torso portion 2 about axis $A_3$. The pulleys, shafts and brake of the shoulder brake transmission 82 can be rotatably mounted to the column portion 130*a* in a similar manner as previously described in embodiments above. Column portion 130*a* can be formed of rectangular tubing.

Figure 34:
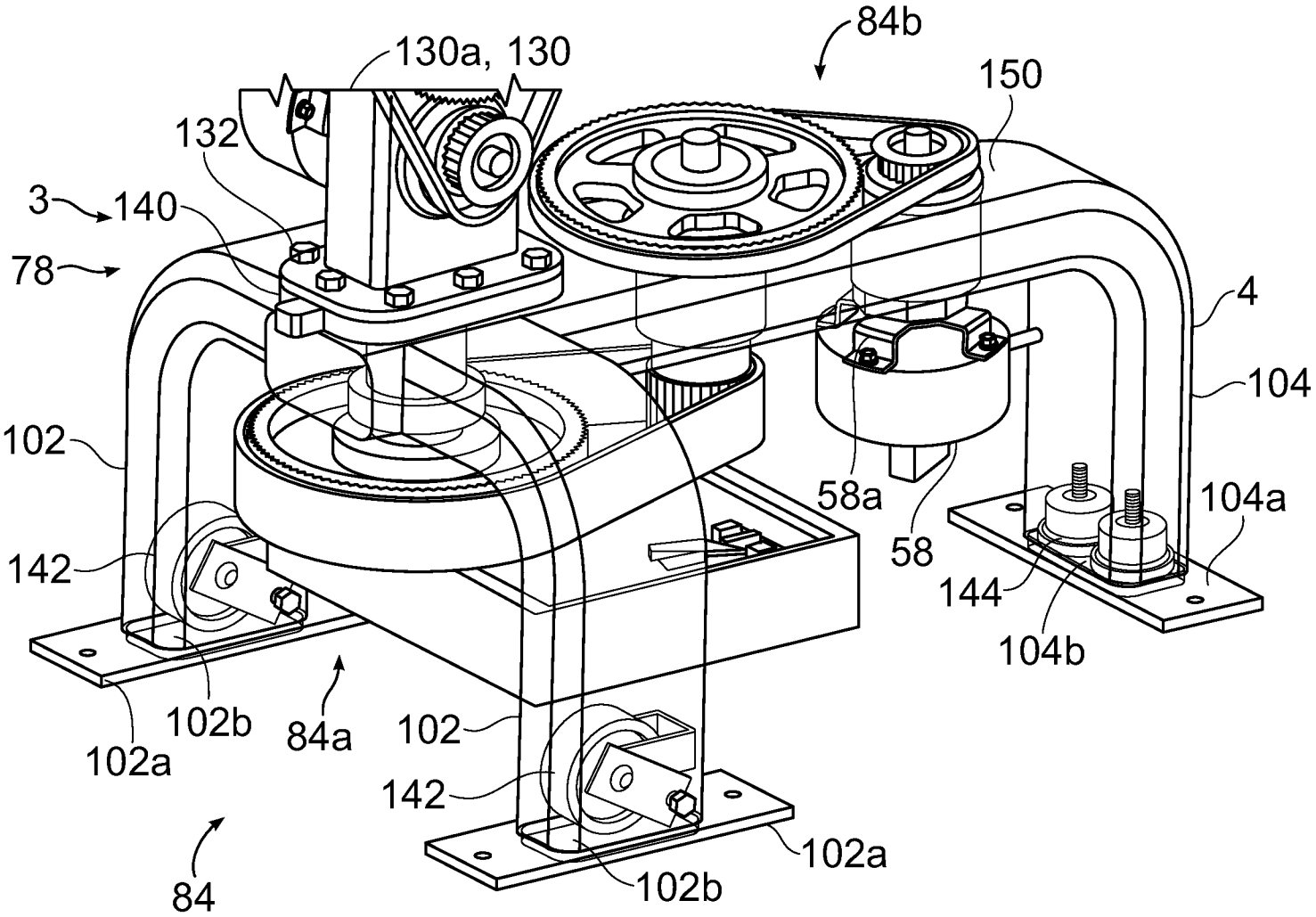
FIGS. 34 and 35 are perspective views of an embodiment of a base and waist azimuthal angular motion stage.
Figure 35:
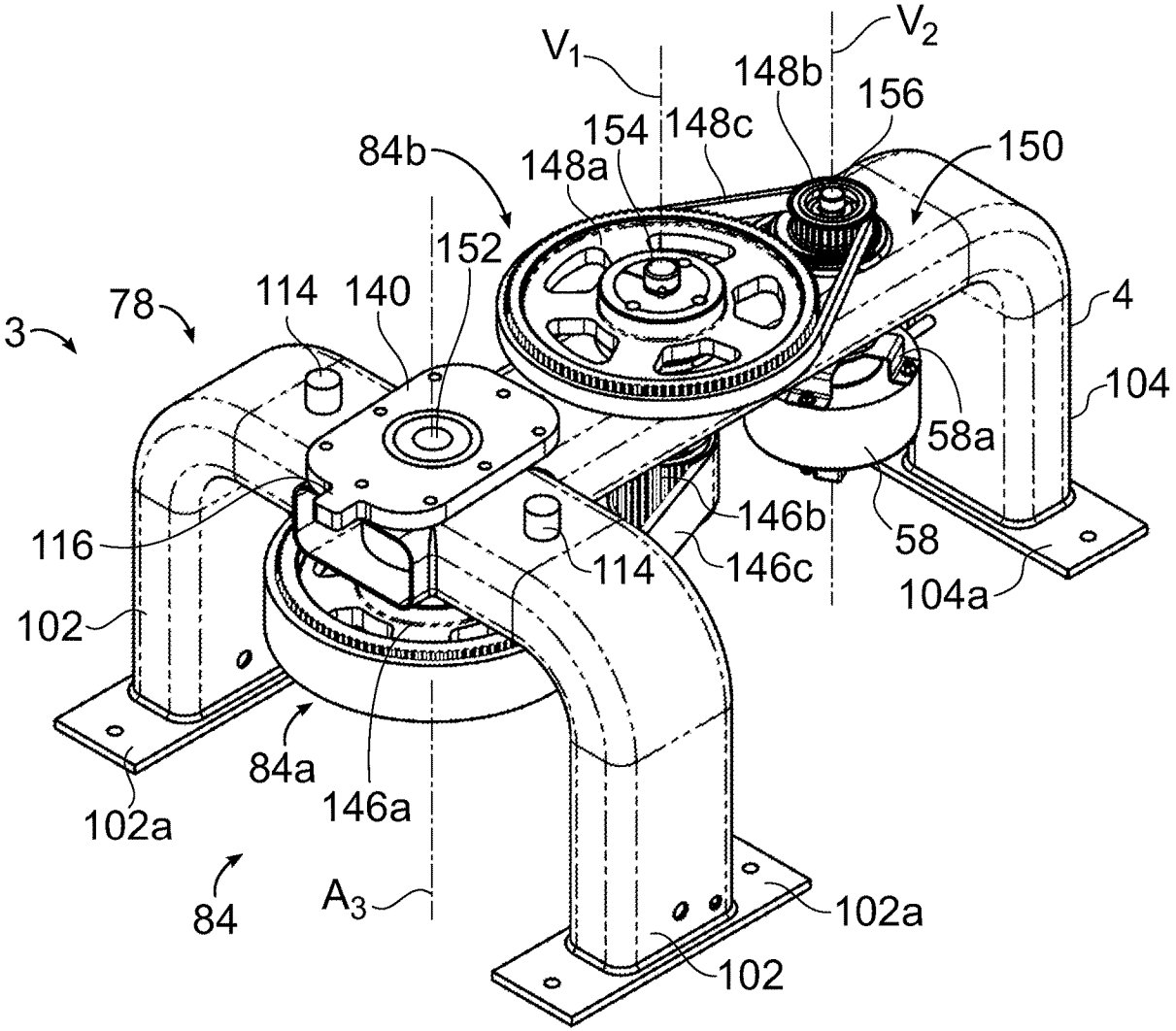

Referring to FIGS. 29, 34 and 35, the base, waist or azimuthal angular motion stage 3 can include a base 4 having a lateral base support member or portion 150 to which a rotatable flange 140 is rotatably mounted on the upper side between the legs 102. The bottom mounting flange 132 of the central support member 130 of torso portion 2 can be secured to flange 140 with fasteners or screws for rotatably mounting the torso portion 2 to the azimuthal angular motion stage 3. The flange 140 can be rotatably coupled by a transmission or drive shaft 152 extending along axis $A_3$ through base portion 150 to the large timing pulley 146*a* of the first pulley transmission stage 84*a* of the waist brake transmission 84, located on the opposite or lower side of the base portion 150. The first transmission stage 82*a* includes a timing belt 146*c* that engages the large pulley 146*a* and a small timing pulley 146*b* rotatably mounted to the lower side of the base portion 150 about vertical axis $V_1$. The small pulley 146*b* is rotatably coupled to the large timing pulley 148*a* of the second pulley transmission stage 84*b* located on the opposite or upper side of base portion 150 by a transmission or drive shaft 154 extending vertically along vertical axis $V_1$ through base portion 150. The second transmission stage 84*b* includes a timing belt 148*c* that engages the large pulley 148*a* and a small timing pulley 148*b* rotatably mounted to the upper side of the base portion 150 along vertical axis $V_2$. The small pulley 148*b* of the second transmission stage 84*b* is rotatably coupled to the waist brake 58 located on opposite or lower side of the base portion 150 by a transmission, drive or brake shaft 156 extending along vertical axis $V_2$ vertically through base portion 150. As a result, the waist brake 58 is located on the same side of the base portion 150 as the first transmission stage 84*a*. The waist brake 58 can be secured to the bottom of base portion 150 by a bracket 58*a* with fasteners. The waist brake 58 and the waist brake transmission 84 can provide bi-directional rotary or rotational resistance or force against the rotation or rotary movement of the torso portion 2 and/or waist joint 78 about axis $A_3$ relative to base stage 3 and base 4. The pulleys, shafts and brake of the waist brake transmission 84 can be rotatably mounted to the base portion 150 in a similar manner as the shoulder brake transmission 82.

Figure 31A:
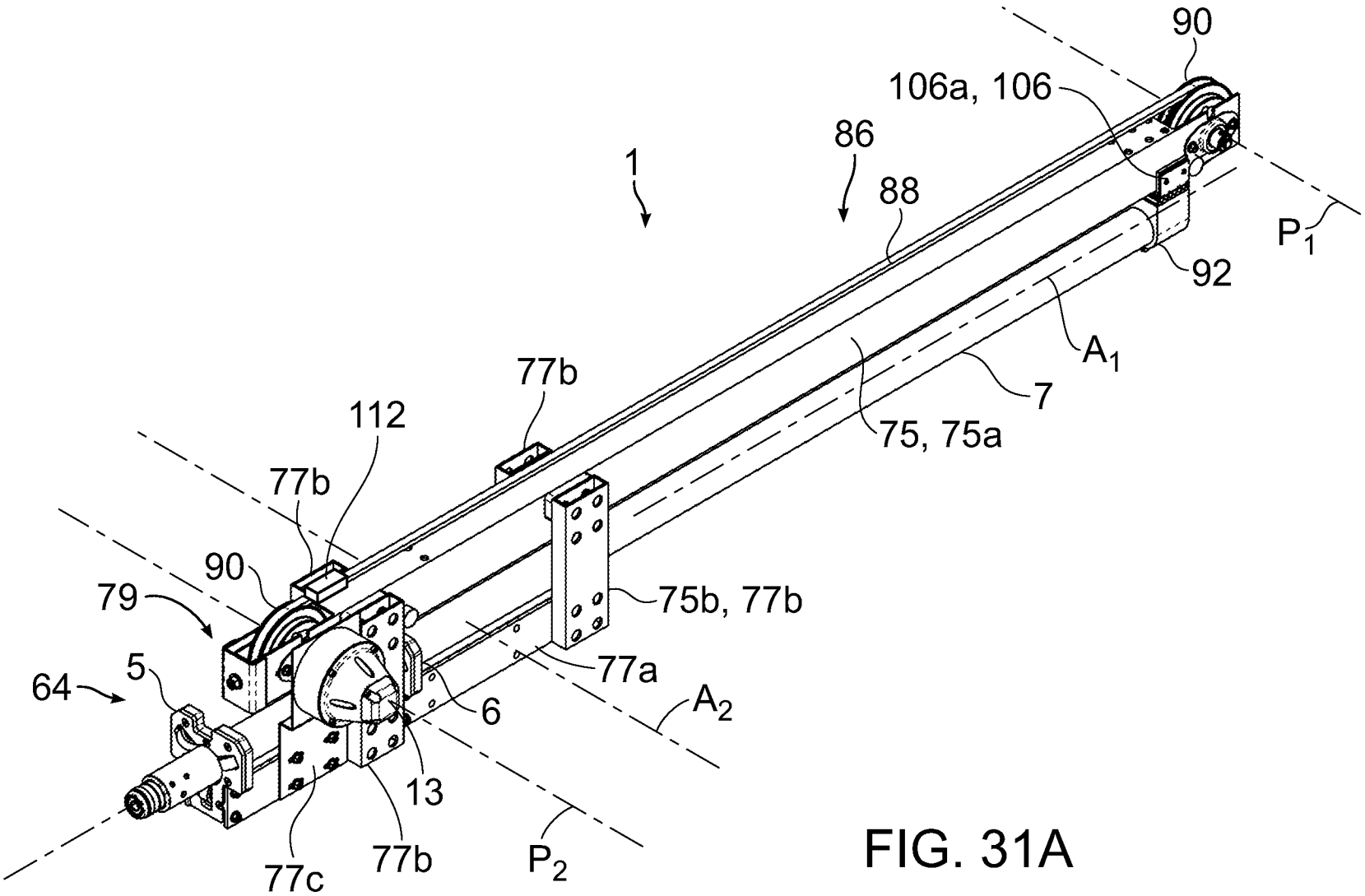
Figures 31B, 31C, 31D:
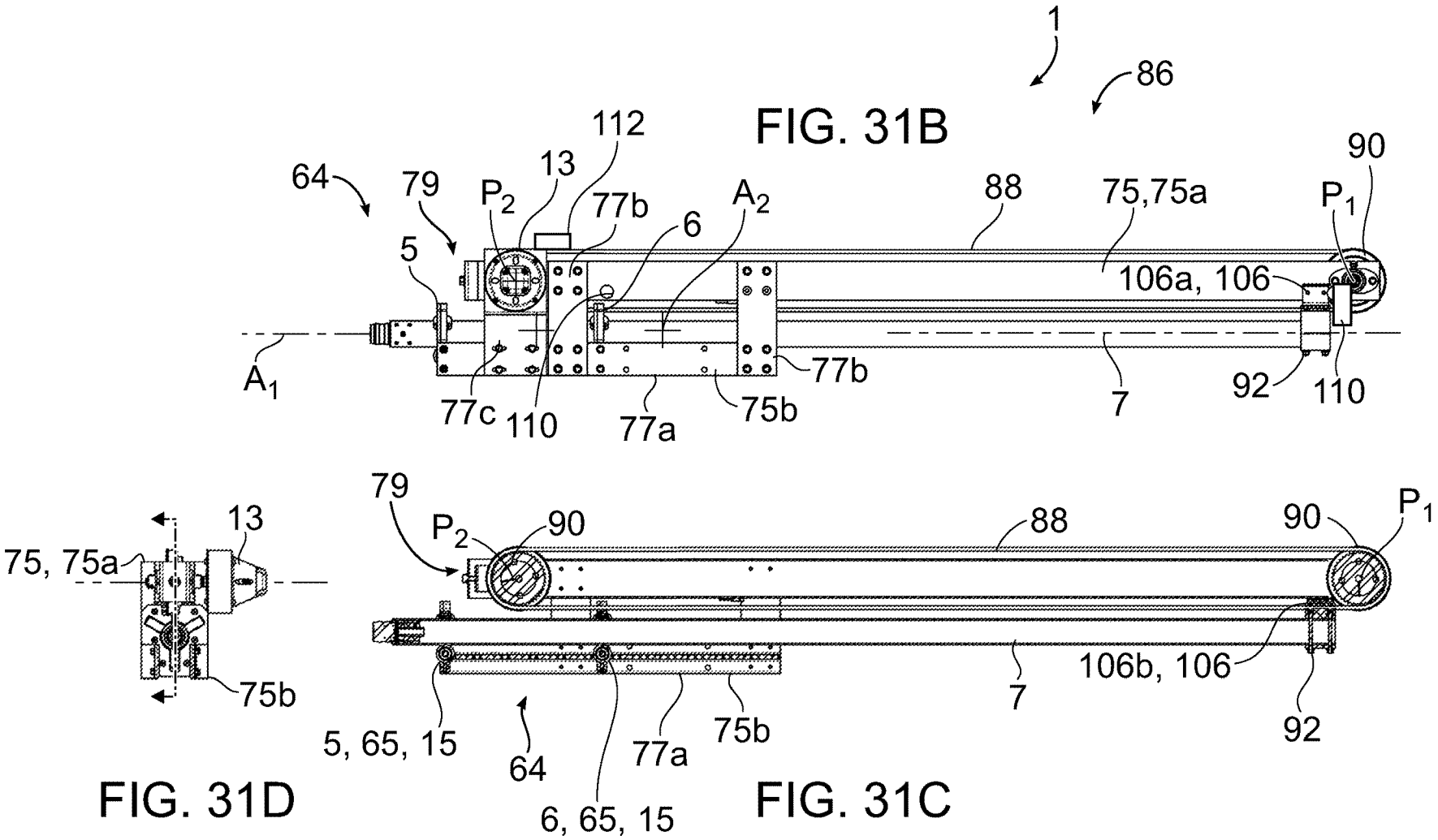
Figure 31E:
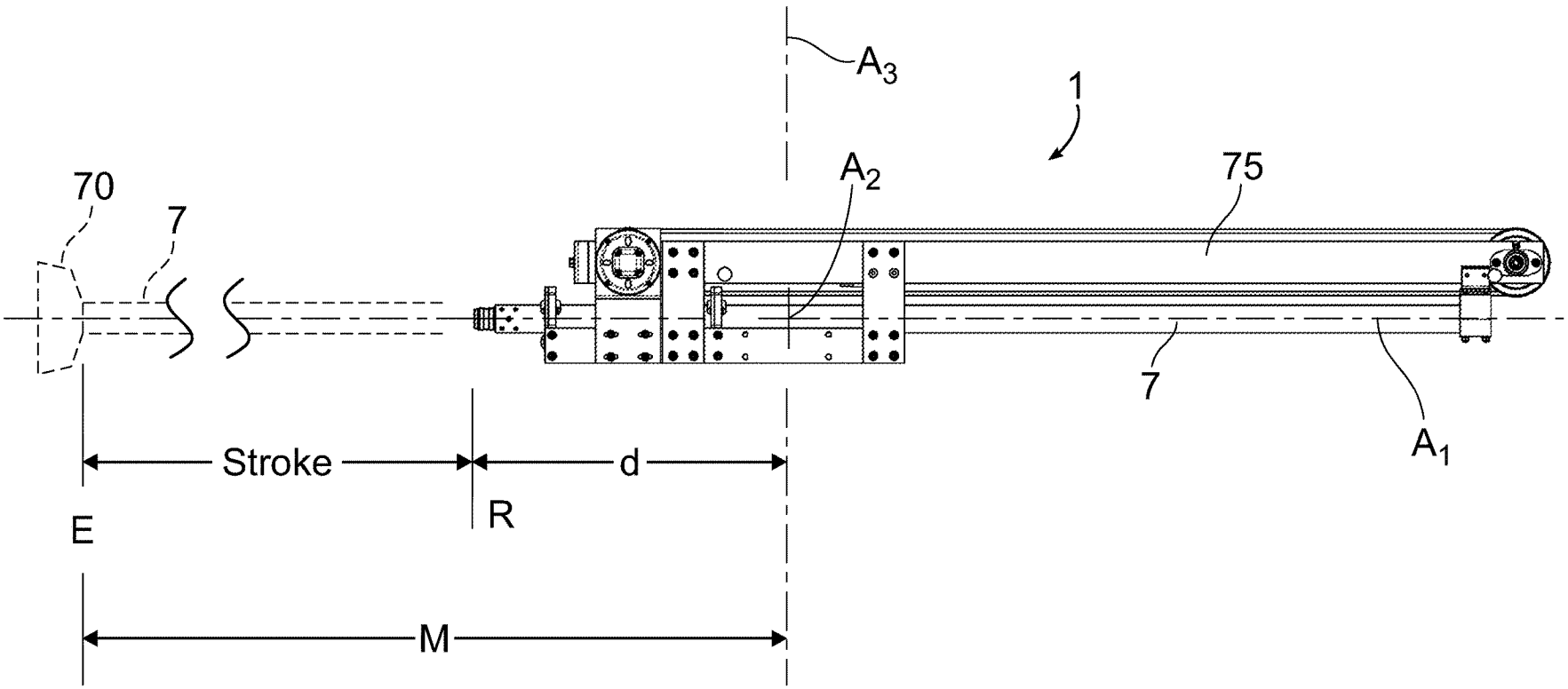
Figure 32:
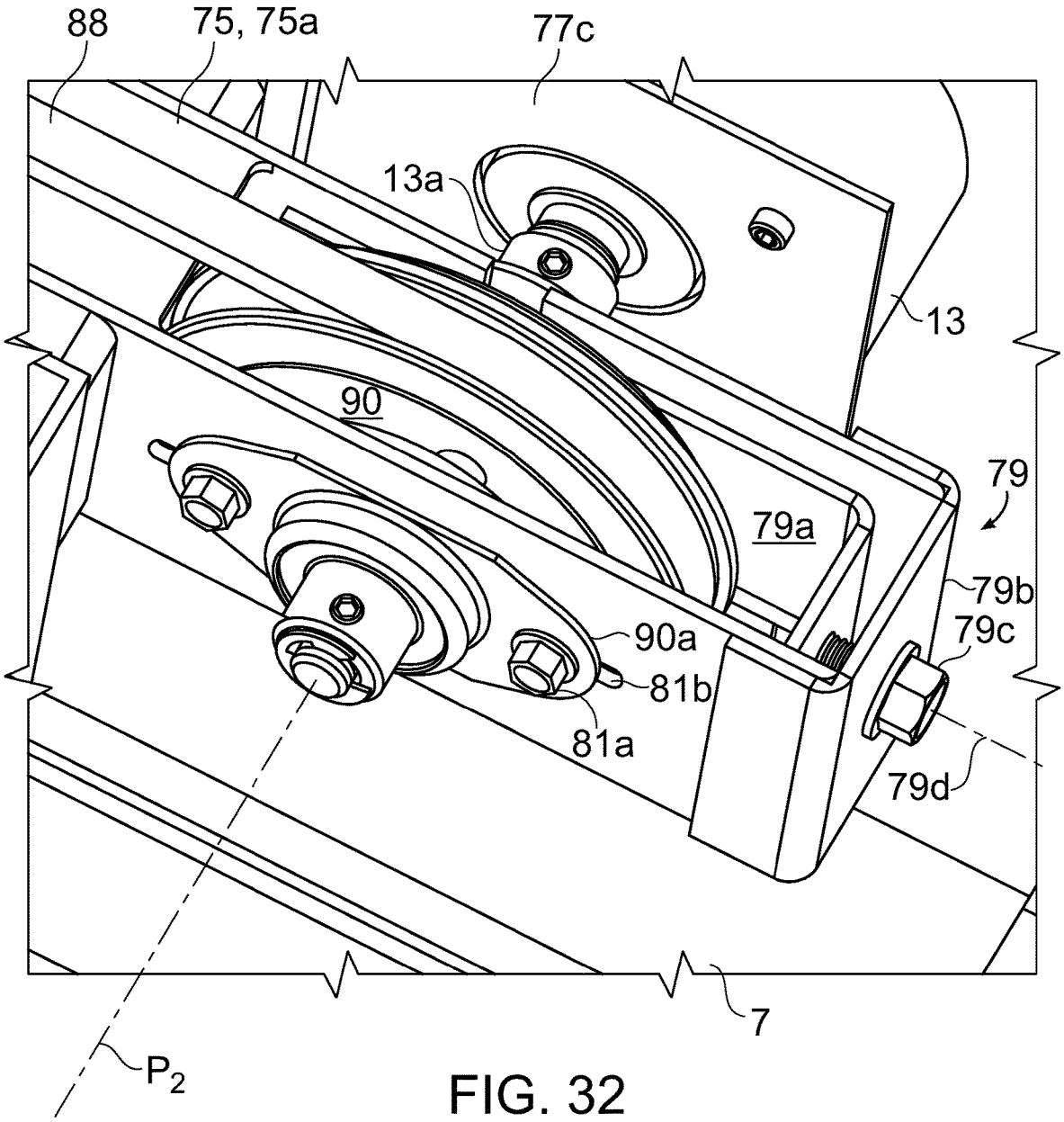
FIG. 32 is an enlarged detail of the linear arm portion showing a belt tension adjusting arrangement.

In some embodiments, the upper support portion 75*a* can weigh about 5-9 lbs. The proximal end of the linear arm portion 1 can extend away from the rotary shoulder joint 76 and axis $A_2$ about ⅔ to ¾ more in length, such as about 5/7 or about 55 inches, than the distal end which can extend about ¼-⅓ in length such as about 2/7 or about 22 inches on the opposite side, while the arm member 7 is in the retracted position R (FIG. 31E). This can result in a ratio between the length or distance of the proximal end and the distal end of the linear arm portion 1, away from axis $A_2$ on opposite sides of axis $A_2$, of about 3:1 to about 2.2:1, and in some embodiments can be about 2.5:1. The proximal end of the linear arm portion 1 and support member 75 can remain at a fixed or constant distance away from axis $A_2$, while the distal end of the linear arm portion 1 and arm member 7 can translate between retracted R and extended E positions. Balance of weight of linear arm portion 1 about shoulder joint 76 and axis $A_2$ can be provided by positioning the arm brake 13 on the distal end on the opposite side of shoulder joint 76 and axis $A_2$ from the proximal end of linear arm portion 1 as a counterbalance, in view that the arm brake 13 can weigh about 12-15 lbs. Although brake 13 can be heavy, by being positioned close to both axes $A_2$ and $A_3$ (for example about 1/7 or ⅛ the length of support member 75 away, or about 11 inches), rotational inertia of arm brake 13 rotating about axes $A_2$ and $A_3$ can be minimized. In some embodiments, axes $A_2$ and $A_3$ can intersect at the rotary shoulder joint 76. In addition, a dynamic or movable counterweight 112 (about 2-5 lbs.) can be secured to the timing belt 88 near or against the distal pulley 90 also on the opposite side of shoulder joint 76 and axis $A_2$ from the proximal end of linear arm portion 1, when the arm member 7 is in the retracted position, to provide further counterbalancing, such as about 1/10 the length of support member 75 away from axis $A_2$ or about 7 inches. When the arm member 7 is extended distally away from shoulder joint 76, the counter weight 112 moves towards the proximal pulley 90 at the proximal end of linear arm portion 1 to counterbalance the weight of the extended arm member 7 about axis $A_2$. The handle 70 when attached to coupler 71, can also provide counterbalance weight when arm member 7 is in the retracted position, and in some embodiments, further counterbalance weights can be added or attached to handle 70 and/or coupler 71. The arm member 7 can be made of light weight material such as aluminum or carbon fiber tubing to minimize inertia and aid in balancing. End stops or bumpers 110 can be positioned on the sides of upper support portion 75*a* to engage connecting member 92 and/or carriage 106 to define the proximal and distal travel limits of the arm member 7, maximizing the travel stroke relative to the length of upper support portion 75*a*.

Referring to FIGS. 29, 34 and 35, the base 4 can include three legs 102/104 which can extend laterally and then downwardly from lateral base portion 150 to provide wide stable support that resists rocking, even when not bolted to the floor. Two legs 102 (a pair) can be positioned on opposite sides of the torso portion 2, and can extend along a common plane with axis $A_3$. A third single leg 104 can extend away from the torso portion 2 between the two legs 102 from the base support, and can be along a common plane with axis $A_3$ that is orthogonal to the common plane of legs 102. The legs 102 and 104 can have respective foot pads 102*a* and 104*a* for bolting to the floor with bolts through mounting holes. Legs 102 and 104 can also include bottom openings 102*b* and 104*b* for providing access to retractable transport rollers 142 housed in legs 102, and leveling pads 144 housed in leg 104. The legs 102/104 and lateral base portion 150 can be formed of rectangular tubing. Two rotational stops 114 can be provided on the base 4 for engaging a protrusion 116 extending from the rotatable flange 140, which is secured to the bottom of the torso portion 2, for limiting rotation of waist joint 78. The torso portion 2 can be shortened in height due to having only two transmission stages, and can experience reduced stress exerted thereon due to the smaller size. The legs 102/104 can be sized to provide the desired height, and can be high enough to provide easy access to components on the underside of base 4. In some embodiments, the base 4 can be about 15 inches high, the torso portion 2 can be about 30 inches high to the shoulder joint 76 axis $A_2$, support member 75 can be about 70 inches long, and the arm member 7 can be about 72 inches long. The largest length of the moment arm M from the end of the arm member 7 to axis $A_2$ and/or $A_3$ when fully extended can be about 77 inches long (FIG. 31E). The stroke length of the arm member 7 between the retracted position R and the extended position E can be about 55 inches.

In some embodiments, the linear arm brake assembly 86 can include two pulleys 90 about 4.2 inches in diameter on which belt 88 is positioned, the distal pulley 90 being rotatably coupled to an arm brake 13 having a rating of about 115 in-lbs. The shoulder brake transmission 82 can have two reduction stages with a ratio of about 13.66:1, and include a first pulley transmission stage 82*a* having about a 3.29:1 ratio rotatably connected in series to a second pulley transmission stage 82*b* having a ratio of 4.15:1, rotatably coupled to a shoulder brake 31 having a rating of about 220 in-lbs. The waist brake transmission 84 can also have two reduction stages with a ratio of about 13.66:1, and include a first pulley transmission stage 84*a* having a ratio of 3.29:1 rotatably connected in series to a second pulley transmission stage 84*b* having a ratio of 4.15:1, rotatably coupled to a waist brake 58 having a rating of about 220 in-lbs. Controller 74 can be secured to the base 4 and can be connected to a monitor screen 74*a* by line 74*b* or wirelessly for controlling operation of the brakes 13, 31 and 58, and the exercises performed on exercise apparatus 100, which can be complex six degree of freedom motions. Further details of embodiments of exercise apparatus 100 can be as follows.

Free-Standing Version

With the addition of extension legs, the exercise apparatus 100 can be used without being bolted to the floor. A freestanding version can increase the amount of facilities that could use exercise apparatus 100 as not every potential client will be able to drill into the floor for mounting.

Belted Linear Sub-Assembly

The linear sub-assembly uses belts, which has significant advantages.

Arm throw length has been optimized (arm throw refers to how far the arm can move from its starting position to its ending position). The start and end bumpers are on the side of the belt mount to allow for near-0 loss of range due to mechanical constraints.

Linear Sub-Assembly Pivot Location

The linear sub-assembly can be configured such that the center of linear sub-assembly is not aligned with the pivot point or shoulder joint 76. This can reduce both the max and min torques on the structure.

Moving the pivot has a cascade of effects including: lowering the overall gear ratio of each sub-assembly (which allows the reduction of the number of pulleys), lowering the stresses on the structure (allowing the use of thinner and smaller tubes), and a more balanced linear sub-assembly system. This in turn yields both cost reductions and improved user experience.

Number of Gear Stages in Each Sub-Assembly

Reducing the torque requirement and upgrading the brakes allows the reduction of the number of gear stages in each sub-assembly from 3 to 2 for the same resistance ratings. This has significant cost, reliability and assembly optimizations.

Electronics Box

The expensive motherboard and touchscreen monitor can be replaced by a single, cheaper Android monitor. The off the shelf components can be replaced by a custom designed electronics board. Software modifications can be made, and the product is cheaper, scalable and more reliable.

Shipping

Exercise apparatus 100 can be taken apart into 4 subassemblies (base, waist, linear, and monitor) and shipped in smaller corrugate boxes. Each subassembly has wiring harnesses to attach all the electronics once fully built on site. Shipping in smaller boxes allows easy logistics and lower shipping costs. It also allows easy storage management at distribution centers.

Exercise apparatus 100 can have hidden wheels in the legs that can be deployed to move the unit. This makes moving+ installing the unit easy and does not require specialized tools or equipment.

Stability

The 3 legs of the base sub-assembly have been optimized to reduce the rocking of the exercise apparatus 100. The legs are spaced out much further than the previous flat mounting plate which also reduces overall stress on the base sub-assembly.

These legs can have mounting flanges that have clearance to fit a hammer drill, which is used to fasten the base sub-assembly to thick concrete floors.

The entirety of the design can fit within 31" door frame without disassembling the system.

Overall:

The base and waist sub-assembly frames can have two pulley stages on each, and each pulley can be subjected to a reduced torque than the apparatus of FIGS. 1-27.

The underlying design of the pulleys, bushings, shafts and belts can be the same or similar.

Base Sub-Assembly:

The base sub-assembly design can include wheels hidden inside of its tubular legs to allow for moving the unit.

The base sub-assembly can have three mounting legs instead of a flat mounting plate.

The largest pulley can be moved from on top of the base sub-assembly frame to the bottom of it. This can allow for better structural strength of the mounting tube. This can also allow for replacement of the belt in the field.

Waist Sub-Assembly:

Pads 122 can be on the waist sub-assembly frame or torso portion 2 fork to limit wear, sound, and create a better experience for the users when the linear sub-assembly is at its extreme ROMs.

The waist sub-assembly or torso portion 2 at the shoulder joint 76 can have a linear arm mounting bracket or cradle 120 that the linear sub-assembly or linear motion portion 1 can be attached to. This cradle design feature can allow the subassemblies to be shipped separately. The cradle is designed to withstand forces of the shoulder brake transmission 82 while fully tensioned. The cradle allows the top most pulley of transmission 82 to be installed and properly tensioned on the mounting shafts while the linear sub-assembly is removed. The cradle allows for easy assembly, and for future changement, upgrade, service, and repair of the entire linear sub-assembly without disassembly of the other sub-assemblies.

Linear Sub-Assembly:

The linear sub-assembly has been mounted about a pivot location for the shoulder joint 76 close or near the distal end.

By having the pivot for the shoulder joint 76 near the distal end, the design has been optimized for balance through brake placement and lightening of most components in the assembly. The arm goes through the rollers. The linear arm belt or system or belted support can provide a 6× safety factor and also includes a tensioning mechanism to properly tighten the belts.

Balance of the linear arm portion about the shoulder joint 76 can be important for the following reasons: 1) to ensure that the arm stays at or close to a horizontal position when the system is not in use (prevent unsafe or unpleasant 'dropping', 2) to ensure a pleasant user experience and reduce the impact that inertia and other factors within machine could have on measured performed data.

Optimized balance can be accomplished by: 1) placing the brake (12-15 lbs) at the front or distal end of the linear stage closest to the user to counterbalance the longer rear end or proximal end of the linear stage assembly; 2) using a (5-9 lb) support rail for the belted linear stage (note that the weight/load req/material/orientation of linear support changed as a result of pivot point change); 3) adding a counterweight (2-5 lbs) mounted to the upper (or in other embodiments, lower) linear stage belt to travel in the opposite direction of the moving proximal or rear end/mounting point (carriage') at the rear or proximal end of the linear stage tube/arm, for the purpose of counteracting gravitational forces of the linear stage tube/arm mounting point ('carriage'). For example: as the arm (and therefore tube end/carriage/mounting point) travels towards the user during use, the counterweight travels away.

The counterweight on the linear subassembly can be on the top or bottom sides of the mounting structure and the counterweight can be made with wheels, low friction material, or other standard linear motion methods. The magnetic brakes can be replaced with other types of brakes. Motors can also be used to create an active system instead of a passive one. The general dimensions of the majority of components can be changed based on structural and customer requirements. The commercial system standard can have a 6× safety factor, while at home systems can have a 4× safety factor.

While example embodiments have been particularly shown and described, it will be understood by those skilled in the art that various changes in form and details may be made therein without departing from the scope of the embodiments encompassed by the appended claims.

Some embodiments can include incremental encoders or homing Hall Switches for providing accurate position output. Features of the various or different embodiments can be combined together or omitted. The size, ratings and specifications of the various components can vary, depending upon the situation at hand. The limb interface device 70 can have suitable configurations for securing to other parts of the body, such as the head, torso or waist and other limbs such as the legs, feet or ankles.

What is claimed is:

1. An exercise apparatus comprising:

a linear arm portion including an elongate arm member having proximal and distal ends and an elongate support member having proximal and distal ends, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

a linear arm brake assembly coupled to the arm member for resisting linear motion of the arm member, the linear arm brake assembly comprising a flexible loop transmission secured to the arm member, and an arm brake that is rotatably coupled to the flexible loop transmission, a flexible loop of the flexible loop transmission engages a first support member rotary member at the proximal end of the support member and a second support member rotary member located at the sliding joint inward from the distal end of the support member, the flexible loop being secured to the arm member by a connecting member; and a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position.

2. The exercise apparatus of claim 1 in which the torso portion includes a central support member extending along a third axis, the torso portion rotatable about the third axis by a rotary waist joint, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion.

3. The exercise apparatus of claim 2 in which the torso portion is rotatably mounted about the third axis to a base by the waist joint, the base including a base support member, a waist brake assembly being mounted to the base support member for resisting movement of the waist joint, the waist brake assembly including a waist brake transmission.

4. The exercise apparatus of claim 3 in which the linear arm brake assembly comprises flexible loop transmission secured to the arm member, and the arm brake that is rotatably coupled to the flexible loop transmission, the shoulder brake assembly comprising at least one timing belt transmission stage rotatably coupled to a shoulder brake, and the waist brake assembly comprising at least one timing belt transmission stage rotatably coupled to a waist brake.

5. The exercise apparatus of claim 4 in which the flexible loop transmission of the linear arm brake assembly engages the first support member rotary member at the proximal end of the support member and the second support member rotary member located at the sliding joint inward from the distal end of the support member, a counterweight being secured to the flexible loop transmission near the second support member rotary member when the arm member is in the retracted position.

6. The exercise apparatus of claim 5 in which the rotary shoulder joint is positioned inward a range of ¼ to ⅓ of the length of the support member from the distal end, the counterweight and the arm brake being positioned on a side of the rotary shoulder joint that is opposite to the proximal end of the support member to provide balancing weight for the linear arm portion about the rotary shoulder joint when the arm member is in the retracted position.

7. The exercise apparatus of claim 3 in which the base includes a pair of legs extending from the base support member on opposite sides of the torso portion, and a third leg extending from the base support member spaced apart from and extending between the pair of legs.

8. The exercise apparatus of claim 7 in which the legs includes at least one of retractable rollers for moving the apparatus, leveling mechanisms for leveling the apparatus, and mounting holes.

9. The exercise apparatus of claim 2 in which the rotary shoulder joint includes a linear arm mounting bracket rotatably mounted to the shoulder brake transmission, the linear arm portion being removably securable to the linear arm mounting bracket.

10. The exercise apparatus of claim 1 in which the sliding joint extends from the distal end of the support member overlapping the support member ⅓ or less of the length of the support member.

11. The exercise apparatus of claim 1 in which the linear arm portion is rotatably mounted about the second axis by the rotary shoulder joint located midway along the length of the support member of the linear arm portion.

12. An exercise apparatus comprising:

a linear arm portion including an elongate arm member having proximal and distal ends and an elongate support member having proximal and distal ends, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

a linear arm brake assembly coupled to the arm member for resisting linear motion of the arm member; the linear arm brake assembly comprises a timing belt transmission secured to the arm member, and an arm brake that is rotatably coupled to the timing belt transmission, the timing belt of the linear arm brake assembly engages a first support member pully at the proximal end of the support member and a second support member pulley located at the sliding joint inward from the distal end of the support member, a counterweight being secured to the timing belt near the second support member pulley when the arm member is in the retracted position; and a torso portion to which the linear arm portion is rotatably mounted about a second axis by a rotary shoulder joint, the rotary shoulder joint being positioned inward a range of ¼ to ⅓ of a length of the support member from the distal end, the counterweight and the arm brake being positioned on a side of the rotary shoulder joint that is opposite to the proximal end of the support member to provide balancing weight for the linear arm portion about the rotary shoulder joint when the arm member is in the retracted position.

13. A method of exercising with an exercising apparatus comprising:

engaging a linear arm portion that includes an elongate arm member having proximal and distal ends and an elongate support member having proximal and distal ends, the distal end of the arm member being engaged by a user, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

resisting linear motion of the arm member with a linear arm brake assembly coupled to the arm member, the linear arm brake assembly comprising a flexible loop transmission secured to the arm member, and an arm brake that is rotatably coupled to the flexible loop transmission, a flexible loop of the flexible loop transmission engages a first support member rotary member at the proximal end of the support member and a second support member rotary member located at the sliding joint inward from the distal end of the support member, the flexible loop being secured to the arm member by a connecting member; and allowing rotary motion of the linear arm portion relative to a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position.

14. The method of claim 13 in which the torso portion includes a central support member extending along a third axis, the torso portion being rotatable about the third axis by a rotary waist joint allowing rotary motion of the torso portion, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion.

15. The method of claim 14 in which the torso portion is rotatably mounted about the third axis to a base by the waist joint, the base including a base support member, a waist brake assembly being mounted to the base support member for resisting movement of the waist joint, the waist brake assembly including a waist brake transmission.

16. The method of claim 15 in which the linear arm brake assembly comprises flexible loop transmission secured to the arm member, and an arm brake that is rotatably coupled to the flexible loop transmission, the shoulder brake assembly comprising at least one timing belt transmission stage rotatably coupled to a shoulder brake, and the waist brake assembly comprising at least one timing belt transmission stage rotatably coupled to a waist brake.

17. The method of claim 16 in which the flexible loop transmission of the linear arm brake assembly engages the first support member rotary member at the proximal end of the support member and the second support member rotary member located at the sliding joint inward from the distal end of the support member, a counterweight being secured to the flexible loop transmission near the second support member rotary member when the arm member is in the retracted position.

18. The method of claim 17 in which the rotary shoulder joint is positioned inward a range of ¼ to ⅓ of the length of the support member from the distal end, the counterweight and the arm brake being positioned on a side of the rotary shoulder joint that is opposite to the proximal end of the support member to provide balancing weight for the linear arm portion about the rotary shoulder joint when the arm member is in the retracted position.

19. The method of claim 15 in which the base supports the exercise apparatus with a pair of legs extending from the base support member on opposite sides of the torso portion, and a third leg extending from the base support member spaced apart from and extending between the pair of legs.

20. The method of claim 19 in which the legs includes at least one of retractable rollers for moving the apparatus, leveling mechanisms for leveling the apparatus, and mounting holes.

21. The method of claim 14 in which the rotary shoulder joint includes a linear arm mounting bracket rotatably mounted to the shoulder brake transmission, the linear arm portion being removably securable to the linear arm mounting bracket.

22. The method of claim 13 in which the sliding joint extends from the distal end of the support member overlapping the support member ⅓ or less of the length of the support member.

23. An exercise apparatus comprising:

a linear arm portion including an elongate arm member having proximal and distal ends and an elongate support member having proximal and distal ends, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

a linear arm brake assembly coupled to the arm member for resisting linear motion of the arm member, the linear arm brake assembly comprising a timing belt transmission secured to the arm member, and an arm brake that is rotatably coupled to the timing belt transmission, the timing belt of the linear arm brake assembly engages a first support member pulley at the proximal end of the support member and a second support member pulley located at the sliding joint inward from the distal end of the support member, a counterweight being secured to the timing belt near the second support member pulley when the arm member is in the retracted position; and a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion including a central support member extending along a third axis, the torso portion rotatable about the third axis by a rotary waist joint, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the shoulder brake assembly comprising at least one timing belt transmission stage rotatably coupled to a shoulder brake, the torso portion being rotatably mounted about the third axis to a base by the waist joint, the base including a base support member, a waist brake assembly being mounted to the base support member for resisting movement of the waist joint, the waist brake assembly including a waist brake transmission, the waist brake assembly comprising at least one timing belt transmission stage rotatably coupled to a waist brake.

24. An exercise apparatus comprising:

a linear arm portion including an elongate arm member having proximal and distal ends and an elongate support member having proximal and distal ends, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

a linear arm brake assembly coupled to the arm member for resisting linear motion of the arm member; and a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion including a central support member extending along a third axis, the torso portion rotatable about the third axis by a rotary waist joint, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the torso portion being rotatably mounted about the third axis to a base by the waist joint, the base including a base support member, a waist brake assembly being mounted to the base support member for resisting movement of the waist joint, the waist brake assembly including a waist brake transmission, the base including a pair of legs extending from the base support member on opposite sides of the torso portion, and a third leg extending from the base support member spaced apart from and extending between the pair of legs, the legs including at least one of retractable rollers for moving the apparatus, leveling mechanisms for leveling the apparatus, and mounting holes.

25. An exercise apparatus comprising:

a linear arm portion including an elongate arm member having proximal and distal ends and an elongate support member having proximal and distal ends, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

a linear arm brake assembly coupled to the arm member for resisting linear motion of the arm member; and a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion including a central support member extending along a third axis, the torso portion rotatable about the third axis by a rotary waist joint, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the rotary shoulder joint including a linear arm mounting bracket rotatably mounted to the shoulder brake transmission, the linear arm portion being removably securable to the linear arm mounting bracket.

26. A method of exercising with an exercising apparatus comprising:

engaging a linear arm portion that includes an elongate arm member having proximal and distal ends and an elongate support member having proximal and distal ends, the distal end of the arm member being engaged by a user, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

resisting linear motion of the arm member with a linear arm brake assembly coupled to the arm member, the linear arm brake assembly comprising a timing belt transmission secured to the arm member, and an arm brake that is rotatably coupled to the timing belt transmission, the timing belt of the linear arm brake assembly engages a first support member pulley at the proximal end of the support member and a second support member pulley located at the sliding joint inward from the distal end of the support member, a counterweight being secured to the timing belt near the second support member pulley when the arm member is in the retracted position; and allowing rotary motion of the linear arm portion relative to a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion includes a central support member extending along a third axis, the torso portion being rotatable about the third axis by a rotary waist joint allowing rotary motion of the torso portion, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the shoulder brake assembly comprising at least one timing belt transmission stage rotatably coupled to a shoulder brake, the torso portion being rotatably mounted about the third axis to a base by the waist joint, the base including a base support member, a waist brake assembly being mounted to the base support member for resisting movement of the waist joint, the waist brake assembly including a waist brake transmission, the waist brake assembly comprising at least one timing belt transmission stage rotatably coupled to a waist brake.

27. A method of exercising with an exercising apparatus comprising:

engaging a linear arm portion that includes an elongate arm member having proximal and distal ends and an elongate support member having proximal and distal ends, the distal end of the arm member being engaged by a user, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

resisting linear motion of the arm member with a linear arm brake assembly coupled to the arm member; and allowing rotary motion of the linear arm portion relative to a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion including a central support member extending along a third axis, the torso portion being rotatable about the third axis by a rotary waist joint allowing rotary motion of the torso portion, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the torso portion being rotatably mounted about the third axis to a base by the waist joint, the base including a base support member, a waist brake assembly being mounted to the base support member for resisting movement of the waist joint, the waist brake assembly including a waist brake transmission, the base supporting the exercise apparatus with a pair of legs extending from the base support member on opposite sides of the torso portion, and a third leg extending from the base support member spaced apart from and extending between the pair of legs, the legs including at least one of retractable rollers for moving the apparatus, leveling mechanisms for leveling the apparatus, and mounting holes.

28. A method of exercising with an exercising apparatus comprising:

engaging a linear arm portion that includes an elongate arm member having proximal and distal ends and an elongate support member having proximal and distal ends, the distal end of the arm member being engaged by a user, the arm member slidably mounted to the support member by a sliding joint positioned at the distal end of the support member, the arm member being movable along a first axis between retracted and extended positions relative to the support member, the sliding joint including first and second bearing assemblies which are spaced apart a sufficient distance from each other for constraining portions of the arm member within the sliding joint along the first axis at the distal end of the support member, wherein the proximal end of the arm member that overlaps with the support member outside of the sliding joint when in retracted positions is capable of some unconstrained lateral movement relative to the first axis;

resisting linear motion of the arm member with a linear arm brake assembly coupled to the arm member; and allowing rotary motion of the linear arm portion relative to a torso portion to which the linear arm portion is rotatably mounted about a second axis by a rotary shoulder joint, the linear arm portion being balanced, the rotary shoulder joint being positioned along a length of the support member at a location that balances the linear arm portion about the rotary shoulder joint at least when the arm member is in the retracted position, the torso portion including a central support member extending along a third axis, the torso portion being rotatable about the third axis by a rotary waist joint allowing rotary motion of the torso portion, a shoulder brake assembly being mounted to the central support member for resisting movement of the rotary shoulder joint, the shoulder brake assembly including a shoulder brake transmission having components positioned on opposite sides of the central support member and the third axis for minimizing rotational size and rotational inertia of the torso portion, the rotary shoulder joint including a linear arm mounting bracket rotatably mounted to the shoulder brake transmission, the linear arm portion being removably securable to the linear arm mounting bracket.

* * * * *